US011655089B2

(12) United States Patent
Umenaka et al.

(10) Patent No.: US 11,655,089 B2
(45) Date of Patent: May 23, 2023

(54) SPOUT-EQUIPPED PACKAGING BAG AND MANUFACTURING METHOD THEREFOR, AND SPOUT-EQUIPPED PACKAGING BAG THAT CONTAINS CONTENTS

(71) Applicant: HOSOKAWA YOKO CO., LTD., Tokyo (JP)

(72) Inventors: Kazuhiro Umenaka, Fujimino (JP); Raizo Kuge, Hanno (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 132 days.

(21) Appl. No.: 16/623,510

(22) PCT Filed: Jun. 7, 2018

(86) PCT No.: PCT/JP2018/021869
§ 371 (c)(1),
(2) Date: Dec. 17, 2019

(87) PCT Pub. No.: WO2018/235618
PCT Pub. Date: Dec. 27, 2018

(65) Prior Publication Data

US 2021/0147131 A1 May 20, 2021

(30) Foreign Application Priority Data

Jun. 22, 2017 (JP) ..... JP2017-122284

(51) Int. Cl.
*B65D 75/00* (2006.01)
*B65D 75/58* (2006.01)
*B65D 81/34* (2006.01)

(52) U.S. Cl.
CPC ..... *B65D 75/008* (2013.01); *B65D 75/5883* (2013.01); *B65D 81/3461* (2013.01); *B65D 2575/583* (2013.01)

(58) Field of Classification Search
CPC .... B65D 5/74; B65D 75/008; B65D 75/5883; B65D 2575/583
See application file for complete search history.

(56) References Cited

U.S. PATENT DOCUMENTS 5,088,642 A * 2/1992 Farber ..... B29C 66/1122 229/125.13
2004/0234175 A1 11/2004 Takita et al.
(Continued)

FOREIGN PATENT DOCUMENTS

CN 1919693 2/2007
CN 201777488 3/2011
(Continued)

OTHER PUBLICATIONS

Chinese Office Actionfor Application No. 201880040809.3, dated Mar. 17, 2021.
(Continued)

*Primary Examiner* — Derek J Battisti
(74) *Attorney, Agent, or Firm* — Nixon Peabody LLP; Jeffrey L. Costellia

(57) ABSTRACT

The present invention is a self-standing spout-equipped packaging bag (1), including a bag body (10) that stores contents, and a spout (12) that is attached to an upper portion of the bag body (10). The bag body (10) includes a tubular barrel portion (20), and a bottom portion (22) which is attached to block an opening end of a lower part of the barrel portion (20). The spout (12) includes a tubular nozzle portion (14), and a flange portion (16) which projects from an outer surface of the nozzle portion (14). An upper end part (21) of the tubular barrel portion (20) over an entire circumference is liquid-tightly adhered to an upper surface
(Continued)

(16*e*) of the flange portion (16) in a state of following a shape of the flange portion (16) in plan view to be in the same shape.

11 Claims, 16 Drawing Sheets

(56) References Cited

U.S. PATENT DOCUMENTS

| | | | | |
|---|---|---|---|---|
| 2005/0069230 | A1 | 3/2005 | Takahashi et al. | |
| 2008/0193057 | A1 | 8/2008 | Nomura et al. | |
| 2010/0047403 | A1* | 2/2010 | Johnson | B65D 81/34 426/113 |
| 2010/0172600 | A1* | 7/2010 | Sherrill | B65D 75/5883 383/10 |
| 2011/0033133 | A1 | 2/2011 | Kujat | |
| 2012/0063705 | A1 | 3/2012 | Arcot | |
| 2012/0170876 | A1* | 7/2012 | Kuge | B65D 31/10 383/120 |
| 2013/0011085 | A1 | 1/2013 | Umenaka | |
| 2016/0023819 | A1* | 1/2016 | Maldonado | B65D 47/2031 222/92 |
| 2018/0208337 | A1* | 7/2018 | Watanabe | B65B 3/12 |
| 2018/0339481 | A1* | 11/2018 | Yeager | B65D 75/44 |

FOREIGN PATENT DOCUMENTS

| | | |
|---|---|---|
| CN | 202295638 | 7/2012 |
| CN | 204766512 | 11/2015 |
| DE | 4214488 | 11/1993 |
| JP | 07-041010 | 2/1995 |
| JP | 2013-244974 | 12/2013 |
| JP | 2016-003055 | 1/2016 |
| JP | 2016-069032 | 5/2016 |
| JP | 2017-036074 | 2/2017 |
| WO | WO-93-16928 | 9/1993 |

OTHER PUBLICATIONS

International Search Report for PCT/JP2018/021869 dated Aug. 21, 2018.

Notice of Allowance in Chinese App. No. 201880040809.3, dated Sep. 28, 2021 (10 pages).

Guanghai Bi, "Food Industry Science and Technology", Issue 04, New retort pouch—Two-way self—Self-standing bag, Aug. 15, 1983.

* cited by examiner

SPOUT-EQUIPPED PACKAGING BAG AND MANUFACTURING METHOD THEREFOR, AND SPOUT-EQUIPPED PACKAGING BAG THAT CONTAINS CONTENTS

TECHNICAL FIELD

The present invention relates to a spout-equipped packaging bag and a manufacturing method therefor, and a spout-equipped packaging bag that contains contents.

Priority is claimed on Japanese Patent Application No. 2017-122284, filed Jun. 22, 2017, the content of which is incorporated herein by reference.

BACKGROUND ART

As packaging bags for accommodating beverages, seasonings, and refilled liquids such as shampoo, self-standing spout-equipped packaging bags in which a spout is attached to a bag body are known. Generally, in spout-equipped packaging bags having self-standing properties, there are many cases where a spout is liquid-tightly attached to an upper portion of a bag body including a pair of flat surface portions such that the spout is interposed between the flat surface portions, and the upper portion of this bag body has a narrowed shape. However, in such spout-equipped packaging bags, when the amount of contents decreases, the upper portion of the bag body is likely to be bent due to the weight of the spout, and therefore it is difficult to ensure sufficient self-standing properties.

A spout-equipped packaging bag in which a spout is attached to a bottom portion of the bag body has also been proposed (Patent Document 1). Since the spout is provided in the bottom portion, this spout-equipped packaging bag exhibits excellent self-standing properties even if the amount of contents decreases. However, since the spout opens downward, a cap may unintentionally become undone, or contents may leak out when the cap is loosely fastened.

In addition, a spout-equipped packaging bag including a bag body which includes a pair of side walls and two gusset portions respectively connecting upper ends of the side walls to each other and lower ends thereof to each other and in which the gusset portions form a top surface portion and a bottom surface portion; and a spout in which a flange portion projects from an outer surface of a nozzle portion has been proposed (Patent Document 2). In the spout-equipped packaging bag, the flange portion is adhered and fixed to the top surface portion of the bag body. In this spout-equipped packaging bag, since the spout is attached to an upper portion of the bag body, even if a cap unintentionally becomes undone or the cap is loosely fastened, contents am unlikely to leak out. In addition, since the top surface portion and the bottom surface portion have a spreading shape, even if the amount of contents decreases, self-standing properties can be easily ensured.

However, in this spout-equipped packaging bag, in order to join the top surface portion and the side walls to each other, an annular seal portion protruding upward is formed throughout the entire circumference of the gusset portion forming the top surface portion. Therefore, for example, when a beverage or the like is stored therein and a user drinks the beverage or the like through the spout, there are cases where this seal portion comes into contact with the face and causes discomfort. In addition, on a side end side of the bag body, the top surface portion is sealed to each of the pair of side walls, and the side walls are sealed together on a side below the top surface portion. Therefore, the seal portion is formed into a Y-shape in side view. Since an intersection part in the Y-shape of this seal portion is particularly hard, when the bag body is held with the hand, if the hand touches this intersection part, significant discomfort is caused.

CITATION LIST

Patent Document

[Patent Document 1]

Japanese Unexamined Patent Application, First Publication No. H07-41010

[Patent Document 2]

Japanese Unexamined Patent Application, First Publication No. 2016-3055

SUMMARY OF INVENTION

Technical Problem

An object of the present invention to provide a spout-equipped packaging bag in which sufficient self-standing properties can be ensured even when the amount of contents decreases and discomfort when in use is reduced, a manufacturing method therefor, and a spout-equipped packaging bag that contains contents.

Solution to Problem

The present invention has the following constitutions.

[1] A self-standing spout-equipped packaging bag is provided, including a bag body that stores contents, and a spout that is attached to an upper portion of the bag body. The bag body includes a tubular barrel portion, and a bottom portion which is attached to block an opening end of a lower part of the barrel portion. The spout includes a tubular nozzle portion, and a flange portion which projects from an outer surface of the nozzle portion. An upper end part of the tubular barrel portion over an entire circumference is liquid-tightly adhered to an upper surface of the flange portion in a state of following a shape of the flange portion in plan view to be in the same shape.

[2] In the spout-equipped packaging bag according to [1], the upper end part of the barrel portion is folded on the upper surface of the flange portion and is adhered to the upper surface in a state of following the shape of the flange portion in plan view to be in the same shape.

[3] In the spout-equipped packaging bag according to [1] or [2], the shape of the flange portion in plan view is substantially a polygonal shape, and the upper end part of the barrel portion is bent along each of sides of the flange portion and is adhered to the upper surface of the flange portion.

[4] In the spout-equipped packaging bag according to any one of [1] to [3], the barrel portion has a tubular shape with no side seal portion which projects outward in plan view.

[5] In the spout-equipped packaging bag according to any one of [1] to [4], the bottom portion folded in half is positioned inside of the barrel portion while having a bend line thereof on an upper side, each of side ends of the bottom portion is adhered to an inner surface of the barrel portion by means of an adhesive film, and the barrel portion and the bottom portion are adhered to each other throughout the entire circumference of the barrel portion of a lower part of the barrel portion.

[6] In a spout-equipped packaging bag that contains contents, the contents are stored inside of the bag body of the spout-equipped packaging bag according to any one of [1] to [5].

[7] A manufacturing method is provided for a self-standing spout-equipped packaging bag, including a bag body that stores contents, and a spout that is attached to an upper portion of the bag body. The bag body includes a tubular barrel portion, and a bottom portion which is attached to block an opening end of a lower part of the barrel portion. The spout includes a tubular nozzle portion, and a flange portion which protrudes from an outer surface of the nozzle portion. An upper end part of the tubular barrel portion over an entire circumference is folded on an upper surface of the flange portion and is liquid-tightly adhered to the upper surface in a state of following a shape of the flange portion in plan view to be in the same shape.

[8] In the manufacturing method for a spout-equipped packaging bag according to [7], the shape of the flange portion in plan view is substantially a polygonal shape. The entire upper end part of the barrel portion is liquid-tightly adhered to the upper surface of the flange portion by repeating an operation in which a portion of the upper end part of the barrel portion is bent along one side of the flange portion and is adhered to the upper surface of the flange portion.

[9] In the manufacturing method for a spout-equipped packaging bag according to [8], after respective parts of the upper end part of the barrel portion are bent along every other side of a plurality of sides of the flange portion and are adhered to the upper surface of the flange portion, remaining parts of the upper end part of the barrel portion are bent along remaining sides of the flange portion and are adhered to the upper surface of the flange portion.

[10] In the manufacturing method for a spout-equipped packaging bag according to [8], after a portion of the upper end part of the barrel portion is bent along one side of the plurality of sides of the flange portion and is adhered to the upper surface of the flange portion, respective parts of the upper end part of the barrel portion are bent along respective sides of the flange portion and are adhered to the upper surface of the flange portion in a sequential order of moving round in one direction in plan view.

[11] In the manufacturing method for a spout-equipped packaging bag according to [8], after a portion of the upper end part of the barrel portion is bent along one side of the plurality of sides of the flange portion and is adhered to the upper surface of the flange portion, respective parts of the upper end part of the barrel portion are bent along respective sides of the flange portion and are adhered to the upper surface of the flange portion in order of moving halfway round respectively in both directions in plan view.

Effects of Invention

In the spout-equipped packaging bag and the spout-equipped packaging bag that contains contents of the present invention, since the upper end part of the tubular barrel portion of the bag body is in a state of following the shape of the flange portion in plan view to be in the same shape and does not have a narrowed shape, sufficient self-standing properties can be ensured even when the amount of contents decreases and discomfort when in use is reduced.

According to the manufacturing method for a spout-equipped packaging bag of the present invention, it is possible to obtain a spout-equipped packaging bag in which sufficient self-standing properties can be ensured even when the amount of contents decreases and discomfort when in use is reduced.

DESCRIPTION OF EMBODIMENT

The definition of the following terms applies throughout this specification and the claims.

"Substantially a polygonal shape" includes a shape in which at least one of a plurality of corner portions in a polygonal shape has an arc shape, in addition to a polygonal shape.

[Spout-Equipped Packaging Bag]

A spout-equipped packaging bag of the present invention includes a bag body that stores contents, and a spout that is attached to an upper portion of the bag body. The bag body includes a tubular barrel portion, and a bottom portion which is attached to block an opening end of a lower part of the barrel portion. The spout-equipped packaging bag of the present invention can stand by itself. In the spout-equipped packaging bag of the present invention, the spout includes a tubular nozzle portion, and a flange portion which projects from an outer surface of the nozzle portion. In addition, an upper end part of the tubular barrel portion over the entire circumference is liquid-tightly adhered to an upper surface of the flange portion in a state of following the shape (matching a shape) of the flange portion in plan view to be in the same shape. That is, the upper part of the barrel portion of the bag body spreads in the same shape as the shape of the flange portion in plan view. Here, the shape in plan view indicates a shape of the flange portion when the spout-equipped packaging bag of the present invention is viewed from above.

Hereinafter, an example of the spout-equipped packaging bag of the present invention will be described. Dimensions and the like of the diagrams exemplified in the following description are examples. The present invention is not necessarily limited to those and can be suitably changed and realized within a range not changing the gist thereof.

Figure 1:
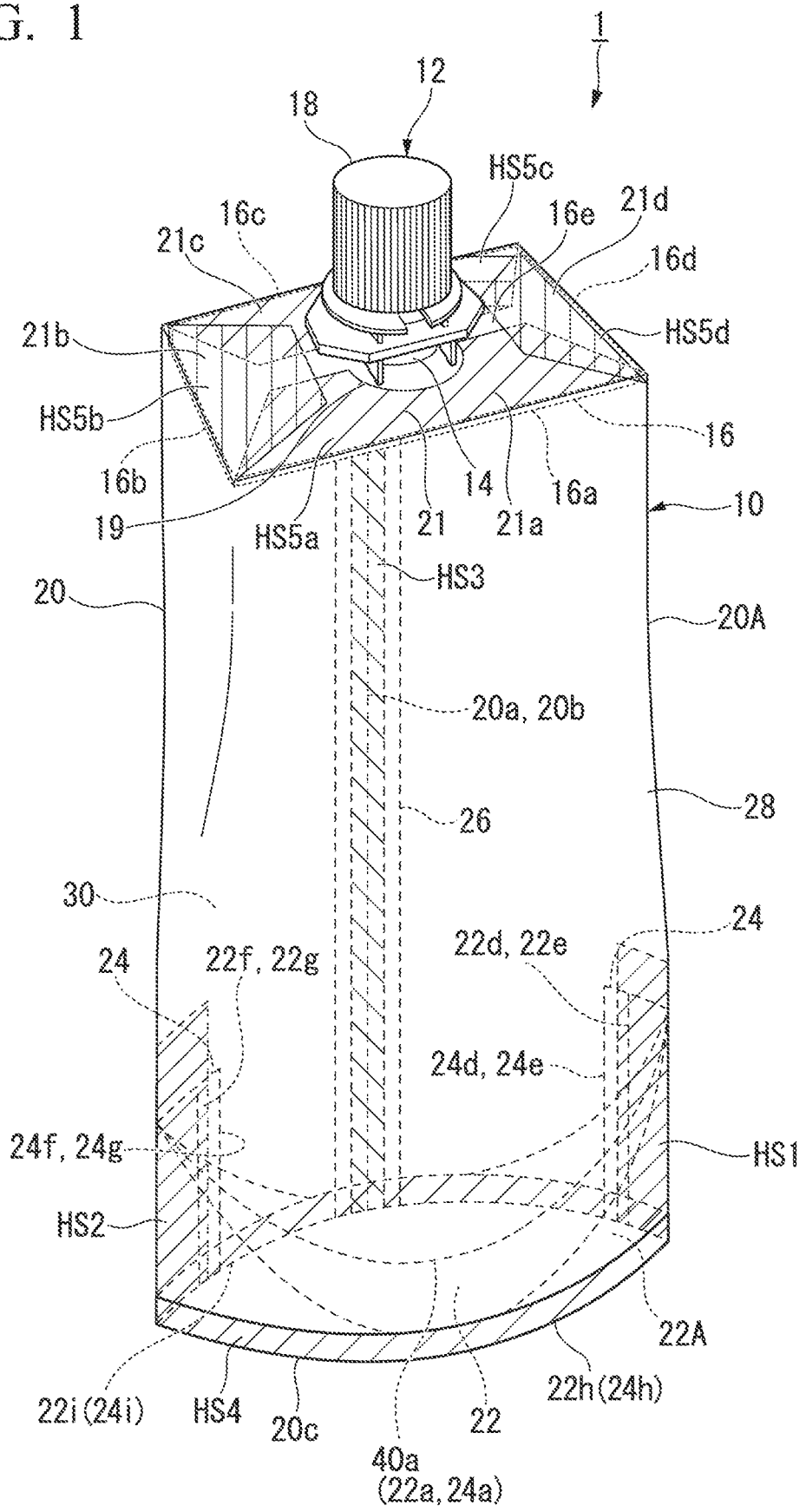
FIG. 1 is a perspective view illustrating an example of a spout-equipped packaging bag of the present invention.

As illustrated in FIG. 1, a spout-equipped packaging bag 1 of the present embodiment includes a bag body 10 that stores contents, and a spout 12 that is attached to the upper portion of the bag body 10.

Figure 2A:
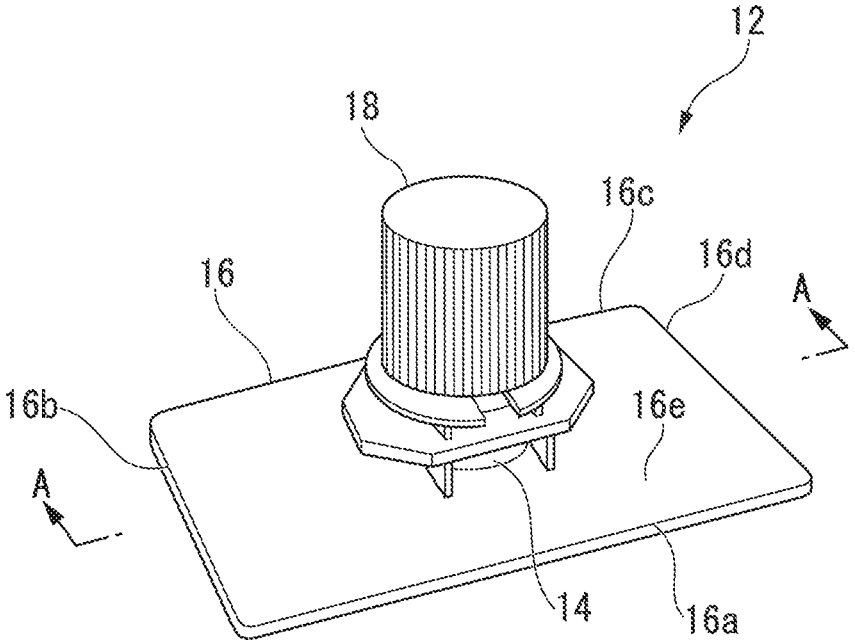
FIG. 2A is a view illustrating a spout of the spout-equipped packaging bag in FIG. 1 and is a perspective view.
Figure 2B:
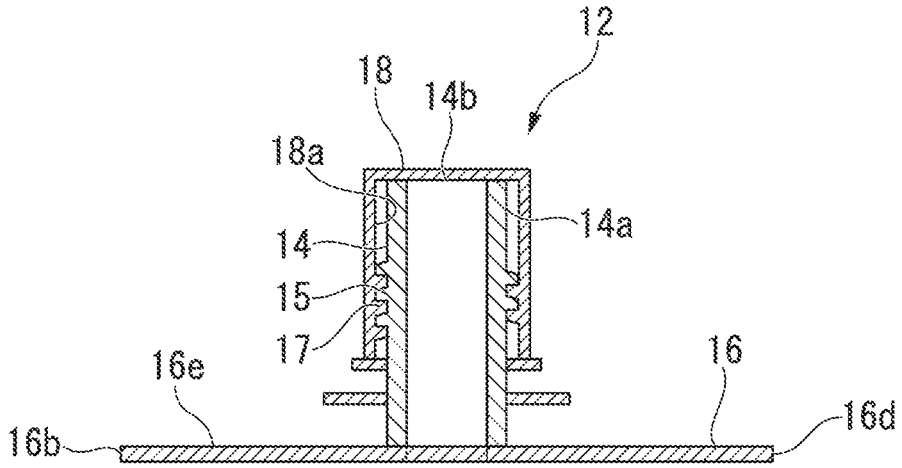
FIG. 2B is a view illustrating the spout of the spout-equipped packaging bag in FIG. 1 and is a cross-sectional view of A-A in FIG. 2A.

The spout 12 is a member for discharging contents stored in the bag body 10 to the outside. As illustrated in FIGS. 2A and 2B, the spout 12 includes a tubular nozzle portion 14, a flange portion 16 which projects from a lower end on an outer surface 14*a* of the nozzle portion 14, and a cap portion 18 which is mounted such that an opening end 14*b* of the nozzle portion 14 on the upper side is blocked.

The spout 12 is provided in the upper portion of the bag body 10 such that the axial direction of the nozzle portion 14 becomes the up-down direction. In the outer surface 14*a* of the nozzle portion 14, a first engagement projection 15 of a protrusion is provided to protrude radially outward and extend spirally. On an inner surface 18*a* of a side wall of the cap portion 18, a second engagement projection 17 of a protrusion is provided to protrude radially inward and extend spirally. In the spout 12, the cap portion 18 can be screwed into the nozzle portion 14 and can be detachably mounted thereon utilizing a screw effect of engagement between the first engagement projection 15 and the second engagement projection 17.

For example, when a beverage is stored inside of the bag body 10, a user can drink the beverage by holding a distal end part of the nozzle portion 14 in the mouth and sucking the beverage after detaching the cap portion 18.

The flange portion 16 has a plate shape and projects from the lower end on the outer surface 14*a* of the nozzle portion 14 in a direction perpendicular to the axial direction of the nozzle portion 14. In the spout 12, the nozzle portion 14 is positioned in a central portion of the flange portion 16 in plan view. In the present invention, the spout is not limited to a form in which the flange portion is provided to project outward from the lower end on the outer surface of the nozzle portion. For example, the present invention may adopt a form in which the flange portion is provided to project outward from a middle portion in the length direction on the outer surface of the nozzle portion.

In this example, the shape of the flange portion 16 in plan view is substantially a rectangular shape in which all of four corner portions of a rectangle have an arc shape in which the corner portions are rounded. The shape of the flange portion 16 in plan view is not limited to the shape in this example. Examples thereof include polygonal shapes such as rectangular shapes and octagonal shapes, shapes in which at least one of a plurality of corner portions in a polygon such as an octagon has an arc shape, and circular shapes.

As the shape of the flange portion in plan view, from the viewpoint that manufacturing of spout-equipped packaging bags is facilitated, it is preferable to adopt substantially a polygonal shape in which the number of corner portions is a multiple of four. It is preferable to adopt a shape in which all of four corner portions of a rectangle as in this example have an arc shape, a rectangular shape, a shape in which all of eight corner portions of an octagon have an arc shape, and an octagonal shape. It is more preferable to adopt a shape in which all of four corner portions of a rectangle have an arc shape, and a rectangular shape.

In addition, if the shape of the flange portion in plan view is a rectangle or a polygon such as an octagon, the upper part of the bag body is easily bent along edges of the flange portion, and a sharp brace extending in the up-down direction is easily formed in the upper part of the bag body. In contrast, if a shape in which all corner portions of a polygonal shape have an arc shape is adopted as the shape of the flange portion in plan view, there is no concern that corner portions of the flange portion will pierce parts corresponding to the corner portions of the flange portion in the upper part of the bag body, and therefore discomfort when the corner portions of the flange portion are held with the hand can be further reduced. In this respect, it is preferable that the shape of the flange portion in plan view be a shape in which all of four corner portions of a rectangle have an arc shape, or a shape in which all of eight corner portions of an octagon have an arc shape.

The flange portion 16 has four linear sides including a first side 16*a*, a second side 16*b*, a third side 16*c*, and a fourth side 16*d*. The first side 16*a* and the third side 16*c* are parallel to each other, and the second side 16*b* and the fourth side 16*d* are parallel to each other. The spout 12 is disposed such that the first side 16*a* becomes the front surface side of the spout-equipped packaging bag 1 and the third side 16*c* becomes the rear surface side of the spout-equipped packaging bag 1.

The size of the flange portion 16 in plan view may be suitably set in accordance with the size of the bag body 10 and the purpose or the like of the spout-equipped packaging bag 1. It is preferable that the length of an outer edge of the flange portion 16 over the entire circumference be the same as or slightly larger than the length of an opening edge on the upper side over the entire circumference in a tubular barrel member 20A forming a barrel portion 20 of the bag body 10.

Although it depends on the kind of a synthetic resin to be used, the thickness of the flange portion 16 is preferably within a range of 0.5 mm to 3.0 mm and is more preferably within a range of 0.7 mm to 1.5 mm. If the thickness of the flange portion 16 is equal to or larger than the lower limit values of the foregoing ranges, the flange portion can have a brace, so that the upper portion of the barrel portion of the spout-equipped packaging bag can be maintained in a spread state.

Regarding the material of the spout 12, it is preferable that at least a part of the flange portion 16 which is adhered to an inner surface of the bag body 10 be formed of a synthetic resin.

Examples of a synthetic resin include a polyolefin resin, a polyamide resin, a polyester resin, a (meth)acrylic resin, a vinyl chloride resin, a vinylidene chloride resin, a polyether sulfone, and an ethylene-vinyl alcohol copolymer. Among these, in terms of excellent workability and low cost, it is preferable to use a polyolefin resin.

Examples of a polyolefin resin include high-density polyethylene, medium density polyethylene, high-pressure-method low-density polyethylene, linear low-density polyethylene, a polyethylene-based resin such as an ethylene-vinyl acetate copolymer, an olefin-based elastomer such as an ethylene-α-olefin copolymer, polypropylene, an ethylene-propylene random copolymer, a polypropylene-based resin such as an α-olefin-propylene random copolymer, and a cyclic polyolefin resin. These resins may be combined in order to improve the performance or may be partially cross-linked for the purpose of improvement in heat resistance and the like.

The spout 12 may be formed of a single material or may be formed to have a multi-layer structure constituted of various resin layers.

Regarding a resin forming at least a part of the flange portion 16 in the spout 12 which is adhered to the inner surface of the bag body 10, in terms of adhesive properties obtained through heat-sealing, it is preferably a resin of the same kind as the resin forming a sealant layer (which will be described below) of the bag body 10 on the inner surface side.

As illustrated in FIG. 1, the bag body 10 includes the tubular barrel portion 20, and a bottom portion 22 which is attached to block the opening end of a lower part of the barrel portion 20.

The barrel portion 20 is formed by causing the rectangular barrel member 20A to be in a tubular shape. It is preferable that the barrel member 20A be made of a film material, at least a base material layer and the sealant layer be laminated, and a laminated film in which the innermost layer that becomes the inner side of the tubular shape of the barrel portion 20 serves as the sealant layer be used.

Regarding the base material layer, it is preferable to use a film on which excellent printing is possible and having piercing strength, tensile strength, shock resistance, and the like. Examples of the material of the base material layer include polyethylene terephthalate, polypropylene, polyamide, and an ethylene vinyl alcohol copolymer. It is preferable to use a biaxially stretched film or a uniaxially stretched film formed of these. In addition, in order to apply barrier properties with respect to oxygen and water vapor, a deposited film obtained by depositing a metal such as aluminum or magnesium or an oxide such as silicon oxide on these films, or a coated film which is coated with a coating agent such as polyvinylidene chloride having barrier properties may be used. The base material layer may be a single body of the foregoing film or may be a laminated body.

The sealant layer is a heat-sealable layer that can be heated and melted within a temperature range in which the shape of the base material layer can be maintained. Examples of the material of the sealant layer include polyethylene such as high-density polyethylene, low-density polyethylene, and linear low-density polyethylene, and polypropylene. It is preferable to use an unstretched film formed of these or a material obtained by extruding the foregoing resin in a layered shape.

As necessary, the laminated film may have an intermediate layer between the base material layer and the sealant layer.

Examples of the intermediate layer include films having functionality such as oxygen barrier properties, water vapor barrier properties, and tearability. Specific examples of the intermediate layer include a metal foil such as aluminum, the deposited film described above, and a coated film.

The base material layer, the sealant layer, and the laminated film including the intermediate layer which is used as necessary can be manufactured by a known method such as a dry lamination method using an adhesive or an extrusion lamination method using a thermoadhesive resin.

The barrel member 20A may be a single-layer film constituted of a heat-sealable film.

Figure 3:
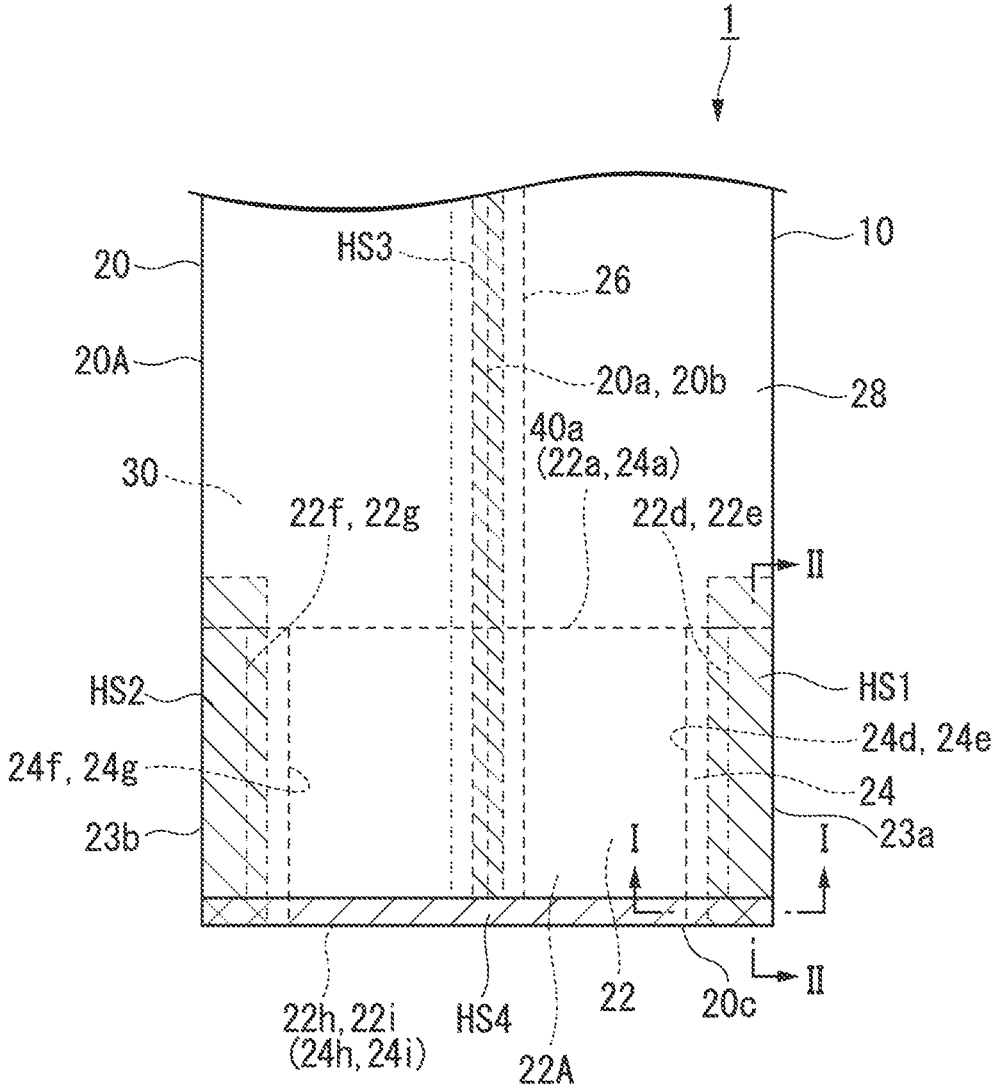
FIG. 3 is an enlarged front view of a part of a bag body on a bottom portion side in the spout-equipped packaging bag of the present invention.
Figure 4A:
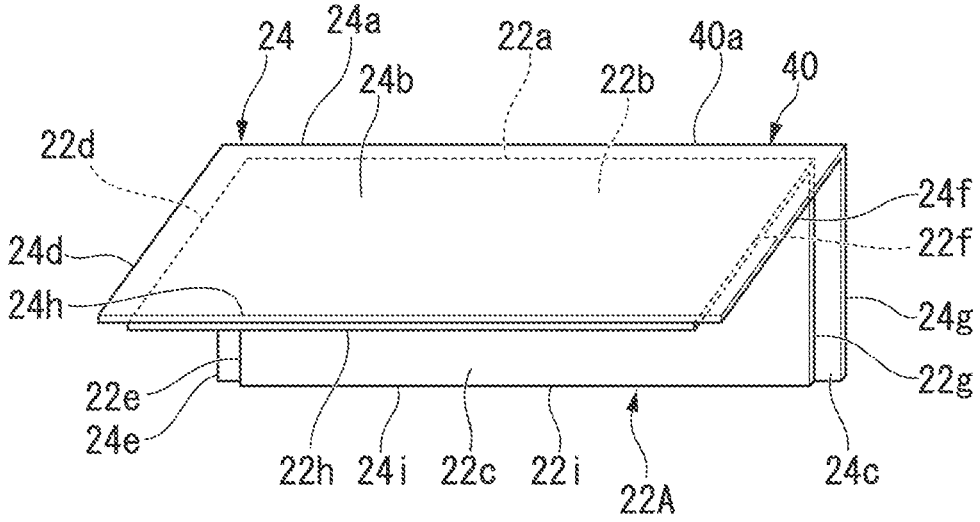
FIG. 4A is a view illustrating one manufacturing step for the spout-equipped packaging bag of the present invention and is a perspective view of a bottom member and an adhesive film.
Figure 4B:
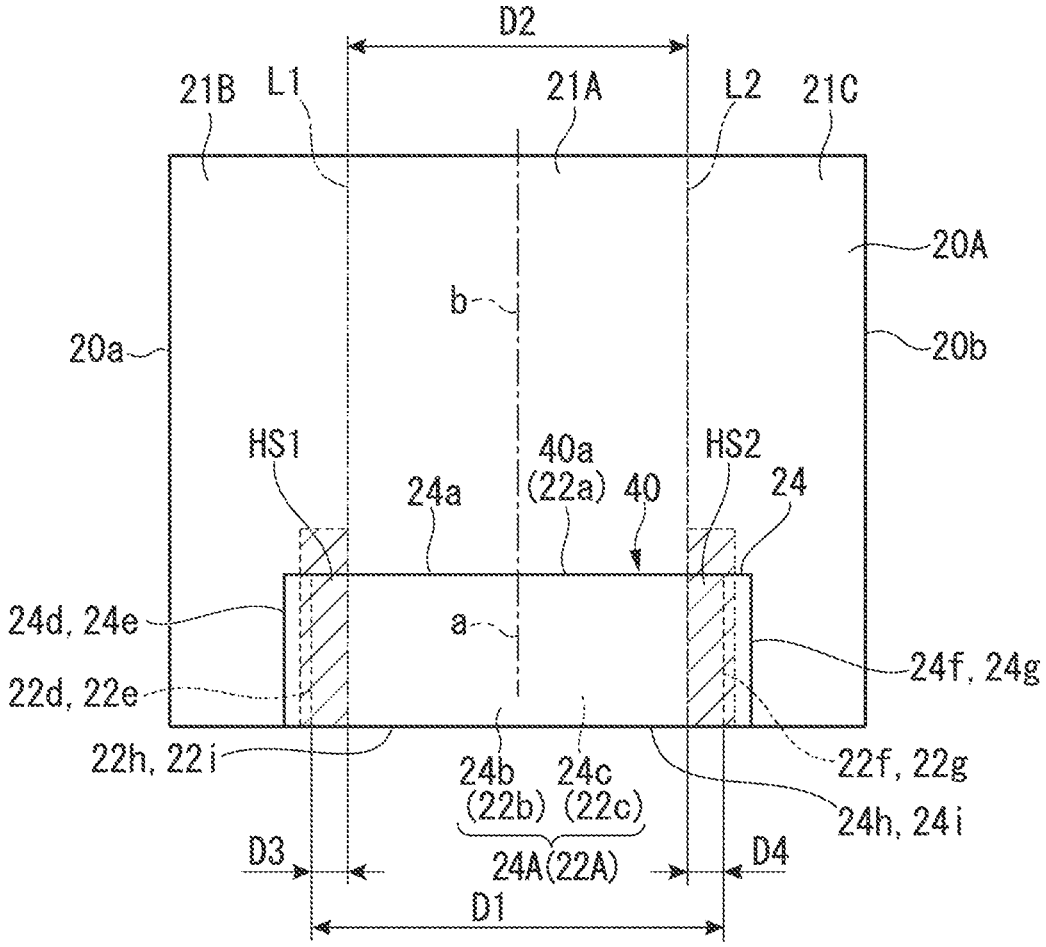
FIG. 4B is a view illustrating one manufacturing step for the spout-equipped packaging bag of the present invention and is a plan view of the deployed spout-equipped packaging bag.

In the present embodiment, both side end sides of the rectangular barrel member 20A are bent along bend lines L1 and L2 indicated in FIG. 4B. As illustrated in FIGS. 1 and 3, a folded back side end 20*a* and a folded back side end 20*b* of the barrel member 20A are caused to abut each other and form a tubular shape. In the barrel portion 20, a part 21A (refer to FIG. 4B) between the bend line L1 and the bend line L2 of the barrel member 20A becomes a part on the front surface side. In the barrel member 20A, a part 21B between the bend line L1 and the side end 20*a*, and a part 21C between the bend line L2 and the side end 20*b* become parts on the rear surface side. Hereinafter, as illustrated in FIG. 3, a part of the barrel portion 20 corresponding to the part 21A of the barrel member 20A when the bag body 10 is in a flat state will be referred to as a front surface portion 28, and parts of the barrel member 20A corresponding to the part 21B and the part 21C will be referred to as a rear surface portion 30.

Here, the bend lines L1 and L2 of the barrel member 20A indicate positions intended to be bent. The bend lines L1 and L2 of the barrel member 20A respectively coincide with side edges 23*a* and 23*b* of the barrel portion 20 when the bag body 10 is in a flat state.

Figure 5A:
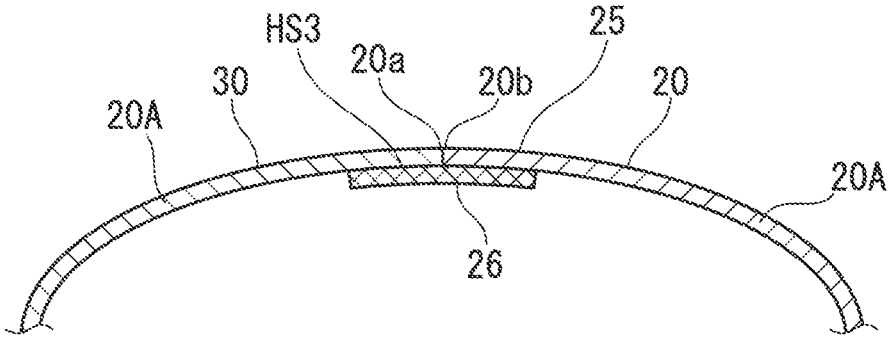
FIG. 5A is a cross-sectional view illustrating an example of an embodiment of a back joint in the spout-equipped packaging bag of the present invention.

In this example, as illustrated in FIGS. 1 and 5A, the side end 20*a* and the side end 20*b* of the barrel member 20A are caused to abut each other such that there is no gap therebetween and are heat-sealed in a heat-seal portion HS3 in a state where an adhesive film 26 overlaps the inner surface sides thereof, such that a back joint 25 is formed and the barrel member 20A has a tubular shape. In such a form, the side end 20*a* and the side end 20*b* of the barrel member 20A may have a slight gap therebetween or may slightly overlap each other, as long as they are sealed by the adhesive film 26 with no gap therebetween.

The adhesive film 26 is a film of which both surfaces have heat-sealing properties to be able to be beat-sealed to the sealant layers of the barrel member and the bottom member and which is formed of a resin of the same kind as the resin forming the sealant layer of the barrel member and the bottom member. Examples of the adhesive film 26 include a laminated film of which both surfaces are sealant layers, a single-layer film, and a co-extruded film. Among these, from the viewpoint that it melts entirely in the thickness direction due to heat of heat-sealing and its thickness becomes thinner, it is preferable to use a synthetic resin film of a single layer as the adhesive film 26.

Figure 5B:
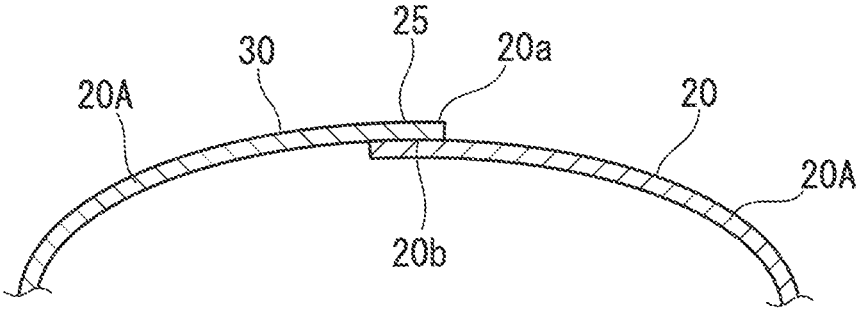
FIG. 5B is a cross-sectional view illustrating another example of the embodiment of the back joint in the spout-equipped packaging bag of the present invention.
Figure 5C:
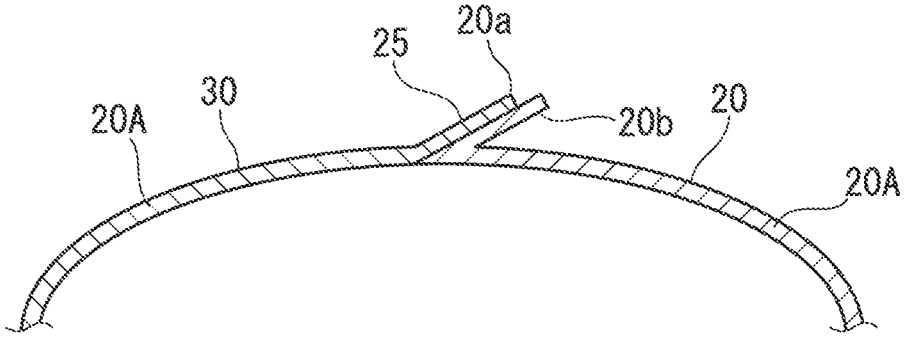
FIG. 5C is a cross-sectional view illustrating another example of the embodiment of the back joint in the spout-equipped packaging bag of the present invention.

The form of the back joint 25 is not limited to a form of using the adhesive film 26. For example, as illustrated in FIG. 5B, an envelope joint in which the inner surface of the side end 20*a* and the outer surface of the side end 20*b* in the barrel member 20A are adhered to each other may be adopted, or as illustrated in FIG. 5C, a butt joint in which the inner surfaces of the side end 20*a* and the side end 20*b* of the barrel member 20A are adhered to each other may be adopted. An envelope joint or a butt joint of the side end 20*a* and the side end 20*b* may be realized through heat-sealing or may be realized using an adhesive.

In the spout-equipped packaging bag 1, the bag body 10 and the spout 12 are adhered to each other as follows, and an upper end part 21 of the tubular barrel portion 20 of the bag body 10 is in a state of following the shape of the flange portion 16 in plan view to be in the same shape. In the upper end part 21 over the entire circumference of the tubular barrel portion 20 of the bag body 10, a portion of the front surface portion 28 when in a flat shape corresponds to the first side 16*a* of the flange portion 16 of the spout 12. A first part 21*a* (corresponding part) on the front surface side is be inward along the first side 16*a* of the flange portion 16 and is heat-sealed to an upper surface 16*e* of the flange portion 16 in a heat-seal portion HS5*a*. The first part 21*a* of the barrel portion 20 is heat-sealed to the upper surface 16*e* of the flange portion 16 in a trapezoidal shape narrowed toward the middle of the flange portion 16 in a state of being bent along the first side 16*a* of the flange portion 16 in plan view.

On a distal end side of the first part 21*a* of the barrel portion 20, a semicircular cut-out portion 19 is formed at a position corresponding to the nozzle portion 14 of the spout 12. When the cut-out portion 19 is not formed, in order to avoid overlapping between the nozzle portion 14 of the spout 12 and the first part 21*a*, there is a need to decrease the dimension of the trapezoidal shape of the first part 21*a* in the height direction.

That is, when the cut-out portion 19 is not formed, them is a need to provide a first ruled line 48*a* (which will be described below) at a position thereabove. When the cut-out portion 19 is formed, compared to a case where the cut-out portion 19 is not formed, the area of the first part 21*a* of the barrel portion 20 adhered to the upper surface 16*e* of the flange portion 16 of the spout 12 can be further increased. In the present invention, in this manner, it is preferable that a cut-out portion be formed in the upper end part of the barrel member at a position corresponding to the nozzle portion of the spout when folded and the area of the barrel member adhered to the upper surface of the flange portion of the spout be increased as much as possible. Accordingly, contents can be more stably inhibited from unintentionally leaking from the upper portion of the bag body.

Similar to the first part 21*a* of the barrel portion 20, in the upper end pan 21 of the tubular barrel portion 20, a portion of the rear surface portion 30 when in a flat shape corresponds to the third side 16*c* of the flange portion 16 of the spout 12. A third part 21*c* (corresponding part) on the rear surface side is heat-sealed to the upper surface 16*e* of the flange portion 16 in a heat-seal portion HS5*c* in a state of being bent along the third side 16*c* of the flange portion 16 to be in a trapezoidal shape in plan view. On a distal end side of the third part 21*c* of the barrel portion 20 as well, similar to the distal end side of the first part 21*a* of the barrel portion 20, the semicircular cut-out portion 19 is formed at a position corresponding to the nozzle portion 14 of the spout 12.

In addition, in the upper end part 21 of the tubular barrel portion 20, a second part 21*b* (between the first part 21*a* on the front surface side and the third part 21*c* on the rear surface side) corresponding to the second side 16*b* of the flange portion 16 of the spout 12 and a fourth part 21*d* (between the third part 21*c* on the rear surface side and the first part 21*a* on the front surface side) corresponding to the fourth side 16*d* of the flange portion 16 are heat-sealed to the upper surface 16*e* of the flange portion 16 respectively in heat-seal portions HS5*b* and HS5*d* in a state of being bent along the second side 16*b* and the fourth side 16*d* of the flange portion 16 to be in a trapezoidal shape in plan view. Portions of the second part 21*b* and the fourth part 21*d* in the upper end part 21 of the barrel portion 20 overlap the first part 21*a* and the third part 21*c* while parts between the first part 21*a* and the third part 21*c*, and the second part 21*b* and the fourth part 21*d* are bent to enter locations below the second part 21*b* and the fourth part 21*d*, respectively.

As described above, the upper end part 21 is folded easily and neatly by folding the upper end part 21 of the tubular barrel portion 20 such that the first part 21*a* to the fourth part 21*d* form a trapezoidal shape in plan view, and therefore it is easy for the spout 12 to be liquid-tightly adhered to the upper portion of the barrel portion 20.

In the heat-seal portions HS5*a* to HS5*d*, the outer surfaces of the barrel member 20A are in contact with each other in regions in which the second part 21*b* and the fourth part 21*d* overlap the first part 21*a* and the third part 21*c* in the upper end part 21 of the barrel portion 20. Generally, the base material layer forming the outer surface does not have heat-sealing properties. Therefore, only the parts may be subjected to adhesion in which an adhesive is applied. However, it is preferable that the outermost layers in at least the foregoing regions of the barrel member 20A have heat-sealing properties and are adhered to each other through heat-sealing. Specific examples of the outermost layer in at least the foregoing regions of the barrel member 20A include a layer formed by applying a partial coating agent having heat-sealing properties on the outer surface, and a layer constituted of a film having heat-sealing properties.

The form in which the upper end part 21 of the barrel member 20A is adhered to the upper surface 16*e* of the flange portion 16 of the spout 12 is not limited to a form performed through heat-sealing. For example, a form performed using an adhesive may be adopted.

In this manner, in the spout-equipped packaging bag 1, the first part 21*a* to the fourth part 21*d* in the upper end pan 21 of the tubular barrel portion 20 are respectively bent along the first side 16*a* to the fourth side 16*d* of the flange portion 16 and are liquid-tightly adhered to the upper surface 16*e* of the flange portion 16 in a state of being folded on the upper surface 16*e* of the flange portion 16. Accordingly, the upper end par 21 of the tubular barrel portion 20 is in a state of following the shape of the flange portion 16 in plan view to be in the same shape and in a spread state. In this manner, when the upper end part 21 of the tubular barrel portion 20 is liquid-tightly adhered to the upper surface 16*e* of the flange portion 16 in a state of being folded throughout the entire circumference, an annular seal portion protruding upward (refer to the spout-equipped packaging bag in Patent Document 2) is not formed around the spout 12 in the upper portion of the spout-equipped packaging bag 1. Therefore, for example, even when a beverage or the like is stored inside of the bag body and a user drinks the beverage or the like through the spout, since a seal portion protruding upward does not come into contact with the face, discomfort is reduced.

In addition, since a particularly hard Y-shaped seal portion (refer to the spout-equipped packaging bag in Patent Document 2) is not formed on a side part side of the bag body 10 of the spout-equipped packaging bag 1, discomfort when the bag body 10 is held with the hand is further reduced.

As illustrated in FIGS. 3 and 4, the bottom portion 22 of the bag body 10 is formed while being adhered to a part below inside of the barrel portion 20 such that the opening end of the tubular barrel portion 20 is blocked while having a bend line 22*a* thereof on the side thereabove in a state where a bottom member 22A formed of a rectangular film material is folded in half. Accordingly, contents can be stored inside of the bag body 10, and the stored contents can be poured out from the spout 12.

When contents are stored inside of the bag body 10, the bottom portion 22 is in a state of being forced to spread downward as illustrated in FIG. 1. Therefore, the spout-equipped packaging bag 1 can stand by itself. When contents are stored inside of the bag body 10, the bottom portion 22 of the bag body 10 has a circular shape or substantially an oval shape when viewed from below, and it may have obtuse corner portions.

As illustrated in FIG. 4A, a surface of the bottom member 22A folded in half is divided into a first bottom surface portion 22*b* and a second bottom surface portion 22*c* by the bend line 22*a* as a border. In a state of being folded in half, a side end 22*d* of the first bottom surface portion 22*b* and a side end 22 of the second bottom surface portion 22*c* coincide with each other, a side end 22*f* of the first bottom surface portion 22*b* and a side end 22*g* of the second bottom surface portion 22*c* coincide with each other, and a lower end 22*h* of the first bottom surface portion 22*b* and a lower end 22*i* of the second bottom surface portion 22*c* coincide with each other. In the bottom portion 22, each of the side ends 22*d* and 22*e* and the side ends 22*f* and 22*g* of the bottom member 22A is adhered to the inner surface of the barrel portion 20, and the lower ends 22*h* and 22*i* of the bottom member 22A are adhered to a lower end 20*c* of the barrel portion 20 throughout the entire circumference of the barrel portion 20.

As illustrated in FIG. 4B, in a process of manufacturing the spout-equipped packaging bag 1, the bottom member 22A in a state of being folded in half is disposed on the barrel member 20A such that a centerline a of the bottom member 22A in the width direction and a centerline b of the barrel member 20A in the width direction substantially coincide with each other while having the second bottom surface portion 22*c* on the barrel member 20A side. In the spout-equipped packaging bag 1, the second bottom surface portion 22*c* faces the front surface portion 28 of the barrel portion 20, and the first bottom surface portion 22*b* faces the rear surface portion 30 of the barrel portion 20.

A length D1 between both side ends of the bottom member 22A folded in half is larger than the width between the bend lines L1 and L2 of the barrel member 20A, that is, a width D2 of the part 21A and exceeds the bend lines L1 and L2 of the barrel member 20A. When the barrel member 20A has a tubular shape, the bottom member 22A is bent together with the barrel member 20A on the bend lines L1 and L2 of the barrel member 20A. That is, the length D1 between both side ends of the bottom member 22A is larger than the width of the barrel portion 20 when the bag body 10 is in a flat shape.

In a self-standing packaging bag in which a bottom portion is formed below a barrel portion by attaching a bottom member folded in half, a load of contents is likely to be concentrated inside of the bag at the upper end of a part along a side edge of the barrel portion in the bottom portion. Therefore, when a corner at the side end of the bottom member folded in half lies along the side edge of the barrel portion, a load of contents is likely to be concentrated on the corner at the side end of the bottom member, and there is a possibility that rupture occurs in this part and the contents leak.

Figure 6A:
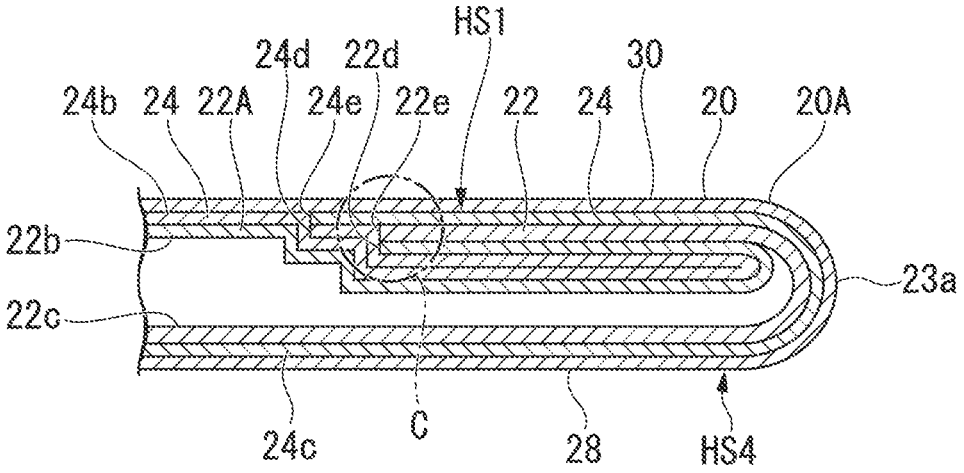
FIG. 6A is a cross-sectional view taken along I-I of the spout-equipped packaging bag in FIG. 3.
Figure 6B:
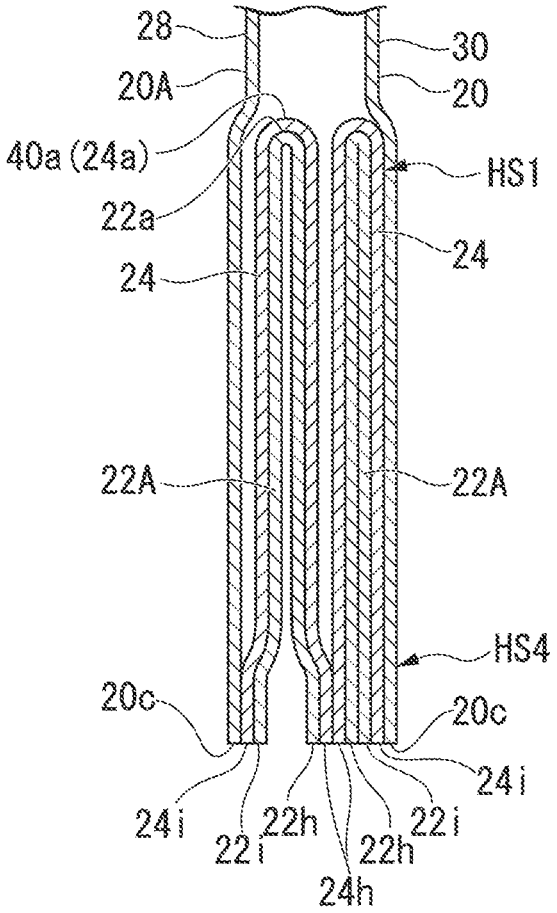
FIG. 6B is a cross-sectional view taken along II-II of the spout-equipped packaging bag in FIG. 3.

In contrast, when the length D1 between both side ends of the bottom member 22A is larger than the width of the barrel portion 20, as illustrated in FIGS. 1, 3, and 6A, the side ends 22*d* and 22*e* side of the bottom member 22A folded in half is bent at the side edge 23*a* of the barrel portion 20 and is attached to the inner surface of the rear surface portion 30. Accordingly, in the spout-equipped packaging bag 1, since a load of contents is received in a part bent together with the barrel member 20A in the bottom member 22A instead of the corners at both ends folded in half on the bend line 22*a* of the bottom member 22A, a significant force is not concentrated on the side edge of the bottom member 22A on the side ends 22*d* and 22*e* side. Therefore, rupture of the bottom member 22A is unlikely to occur in parts of the side ends 22*d* and 22*c*, and an effect of inhibiting leakage of contents is high. Similarly, the side ends 22*f* and 22*g* side of the bottom member 22A folded in half is bent at the side edge 23*b* of the barrel portion 20, and the side ends 22*f* and 22*g* are attached to the inner surface of the rear surface portion 30. Accordingly, rupture of the bottom member 22A is also unlikely to occur in parts of the side ends 22*f* and 22*g*, and an effect of inhibiting leakage of contents becomes high.

In the spout-equipped packaging bag of the present invention, the side end of the bottom member folded in half may coincide with the side edge of the barrel portion.

Figure 7:
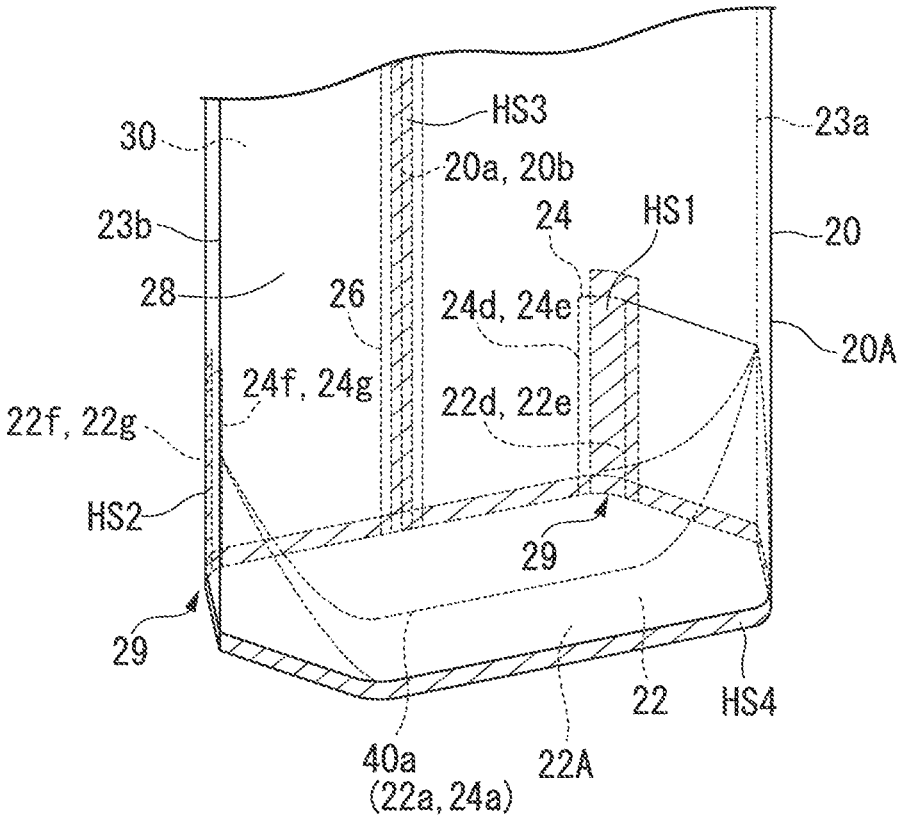
FIG. 7 is a perspective view partially illustrating another form in a state where contents are stored in the spout-equipped packaging bag of the present invention.

The distance between the side ends 22*d* and 22*e* of the bottom member 22A and the side edge 23*a* of the barrel portion 20, that is, a distance D3 between the side ends 22*d* and 22*e* of the bottom member 22A and the bend line L1 of the barrel member 20A is preferably 1.0 mm or longer and is more preferably 3.0 mm or longer. If the distance D3 is 1.0 mm or longer, it is easy to inhibit rupture of pans of the side ends 22*d* and 22*e* of the bottom member 22A and leakage of contents. If the distance D3 has a length to a certain extent, when the spout-equipped packaging bag is filled with contents, as illustrated in FIG. 7, positions corresponding to the positions of the side ends 22*d* and 22*e* of the bottom member 22A in the barrel member 20A become bend lines, such that the barrel member 20A is bent and obtuse corner portions 29 are easily formed on the bottom portion 22 side of the barrel portion 20. They are easily formed when a rigid laminated body, such as a laminated body in which a metal such as an aluminum foil is laminated on a film, is used as the barrel member and the bottom member. In addition, in this case, although the length of the distance 13 to a certain extent is influenced by the size of the spout-equipped packaging bag, the corner portions are easily formed when it has a distance of at least 10 mm or longer.

In addition, a preferable range of the distance between the side ends 22*f* and 22*g* of the bottom member 22A and the side edge 23*b* of the barrel portion 20, that is, a distance D4 between the side ends 22*f* and 22*g* of the bottom member 22A and the bend line L2 of the barrel member 20A is similar to that of the distance D3.

The distance D3 and the distance D4 may be the same as each other or may be different from each other. However, in terms of an even better appearance, it is preferable that they be the same as each other.

Regarding the bottom member 22A, it is preferable to use a laminated film in which at least the base material layer and the sealant layer are laminated. The bottom member 22A is folded in half having the sealant layer on the outer side, and the innermost layer on a side facing the inner surface of the barrel portion 20 inside of the bag body 10 is the sealant layer. Examples of the base material layer and the sealant layer of the bottom member 22A can be the same as the examples of the base material layer and the sealant layer in the barrel member 20A. In addition, when the bottom member 22A is a laminated film, it may have an intermediate layer. Examples of the intermediate layer of the bottom member 22A can be the same as the examples of the intermediate layer in the barrel member 20A.

The bottom member 22A and the barrel member 20A may be constituted of films of the same materials or may be constituted of films of the different materials. However, from the viewpoint that they can be adhered to each other through heat-sealing, it is preferable that both be laminated films having a sealant layer formed of a resin of the same kind.

Regarding the laminated body of the bottom member and the adhesive film (which will be described below), when a laminated film in which the bottom member and the adhesive film are integrated is used, the adhesive film may also serve as the sealant layer of the bottom member.

As illustrated in FIGS. 3, 4A, and 4B, on the barrel portion 20 side in the bottom member 22A, that is, on a side inward from the bottom member 22A in the bag body 10, an adhesive film 24 for causing the side ends 22*d* and 22*e* and the side ends 22*f* and 22*g* of the bottom member 22A to be adhered to the barrel portion 20 is laminated such that the bottom member 22A in its entirety is covered. The side ends 22*d* and 22*e* and the side ends 22*f* and 22*g* of the bottom member 22A are adhered to the inner surface of the barrel portion 20 utilizing the adhesive film 24.

The adhesive film 24 is laminated on a surface of the sealant layer of the bottom member 22A. Here, the term "being laminated" may indicate a state where the bottom member 22A and the adhesive film 24 are adhered to each other on the entire surface or a state where only parts thereof are adhered to each other, and also includes a state of merely overlapping each other without being adhered to each other. Then, when the bottom member 22A is interposed between the adhesive films 24, both the adhesive film 24 and the bottom member 22A are folded in half on a bend line 24*a*. A surface of the adhesive film 24 folded in half is divided into a first flat surface portion 24*b* and a second flat surface portion 24*c*.

In a state of being folded in half, a side end 24*d* of the first flat surface portion 24*b* and a side end 24*e* of the second flat surface portion 24*c* coincide with each other, a side end 24*f* of the first flat surface portion 24*b* and a side end 24*g* of the second flat surface portion 24*c* coincide with each other, and a lower end 24*h* of the first flat surface portion 24*b* and a lower end 24*i* of the second flat surface portion 24*c* coincide with each other. The second flat surface portion 24*c* of the adhesive film 24 is positioned on the part 21A of the barrel member 20A side, that is, on the front surface side of the barrel portion 20 in the spout-equipped packaging bag 1. Meanwhile, the first flat surface portion 24*b* of the adhesive film 24 is positioned on the rear surface side of the barrel portion 20 in the spout-equipped packaging bag 1.

As illustrated in FIG. 4A, the side ends 24*d* and 24*e* on one side in the adhesive film 24 folded in half protrude in the width direction from the side ends 22*d* and 22*e* on one side in the bottom member 22A folded in half. In addition, the side ends 24*f* and 24*g* on the opposite side in the adhesive film 24 folded in half protrude in the width direction from the side ends 22*f* and 22*g* on the opposite side in the bottom member 22A folded in half. In this manner, each of the side ends 24*d* and 24*e* and the side ends 24*f* and 24*g* on both sides in the adhesive film 24 protrudes in the width direction from the bottom member 22A.

In the spout-equipped packaging bag 1, as illustrated in FIGS. 1, 3, and 6A, in a state where both the side ends 24*d* and 24*e* side of the adhesive film 24 and the side ends 22*d* and 22*e* side of the bottom member 22A are bent at the side edge 23*a* of the barrel portion 20, the adhesive film 24, the bottom member 22A, and the barrel portion 20 are adhered to each other through heat-sealing in a heat-seal portion HS1 including the side ends 22*d* and 22*e* of the bottom member 22A. Specifically, in the heat-seal portion HS1, the adhesive film 24 and the bottom member 22A are adhered to each other, the adhesive film 24 and a part on the rear surface side of the barrel portion 20 are adhered to each other, and parts of the adhesive film 24 protruding from the bottom member 22A are adhered to each other. Accordingly, the side ends 22*d* and 22*e* of the bottom member 22A are closed by the adhesive film 24 and are attached to the inner surface of the barrel portion 20 on the rear surface portion side through adhesion. An end of the heat-seal portion HS1 in the height direction is formed beyond the bend line 22*a* of the bottom member 22A folded in half. In addition, an end of the heat-seal portion HS1 in the width direction will be described below.

Similarly, in a state where both the side ends 24*f* and 24*g* side of the adhesive film 24 and the side ends 22*f* and 22*g* side of the bottom member 22A are bent at the side edge 23*b* of the barrel portion 20, the adhesive film 24, the bottom member 22A, and the barrel portion 20 are adhered to each other through heat-sealing in a heat-seal portion HS2 including the side ends 22*f* and 22*g* of the bottom member 22A. Specifically, in the heat-seal portion HS2, the adhesive film 24 and the bottom member 22A are adhered to each other, the adhesive film 24 and a part on the rear surface side of the barrel portion 20 are adhered to each other, and parts of the adhesive film 24 protruding from the bottom member 22A are adhered to each other. Accordingly, the side ends 22*f* and 22*g* of the bottom member 22A are closed by the adhesive film 24 and are attached to the inner surface of the barrel portion 20 on the rear surface side through adhesion. An end of the heat-seal portion HS2 in the height direction is formed beyond the bend line 22*a* of the bottom member 22A folded in half. In addition, an end of the heat-seal portion HS2 in the width direction will be described below.

In the spout-equipped packaging bag 1, since both the side ends 24*d* and 24*e* and the side ends 24*f* and 24*g* of the adhesive film 24 respectively protrude in the width direction from both the side ends 22*d* and 22*c* and the side ends 22*f* and 22*g* of the bottom member 22A and there is one adhesive film 24, it is easy to control the positional relationship between the bottom member 22A and the adhesive film 24 which are laminated. Accordingly, even if the spout-equipped packaging bag 1 has a small size, it is easy to inhibit a positional deviation between the bottom member 22A and the adhesive film 24 and the occurrence of an adhesive failure, and therefore it is easy to inhibit leakage of contents regardless of the size.

The adhesive film 24 is a member having a function of attaching the side ends 22*d* to 22*g* on both sides in the bottom member 22A to the inner surface of the barrel portion 20 through adhesion and is a film of which both surfaces have heat-sealing properties. Regarding the adhesive film 24, from the viewpoint that it has sealing properties to be able to be heat-sealed to the sealant layers of the barrel member and the bottom member, a film formed of the same material as the film in the adhesive film 26 can be used, it melts entirely in the thickness direction due to heat of heat-sealing, and its thickness becomes thinner, it is preferable to use a synthetic resin film of a single layer. In addition, if the adhesive film 26 is a synthetic resin film of a single layer, the adhesive film 24 melts in the heat-seal portion HS1 and the heat-seal portion HS2 due to heat of heat-sealing and is likely to enter a stepped part on the border formed depending on the presence or absence of the side ends 22*d* and 22*e* of the bottom member 22A and a stepped part on the border formed depending on the presence or absence of the side ends 22*f* and 22*g*, and therefore a heat-sealing failure is less likely to occur.

In the spout-equipped packaging bag 1 in this example, as illustrated in FIG. 4B, in the parts 21B and 21C of the barrel member 20A, one end of the heat-seal portion HS1 in the width direction is formed to reach the bend line L1, and one end of the heat-seal portion HS2 in the width direction is formed to reach the bend line L2. That is, in the rear surface portion 30 of the barrel portion 20, the heat-seal portion HS1 is formed to reach the side edge 23*a* of the barrel portion 20, and the heat-seal portion HS2 is formed to reach the side edge 23*b* of the barrel portion 20. In the spout-equipped packaging bag 1, it is preferable that a part which is adhered to the adhesive film 24 in a part of the barrel portion 20 to which both the side ends 22*d* and 22*e* and the side ends 22*f* and 22*g* of the bottom member 22A are attached be only the rear surface portion 30 without straddling the bend lines L1 and L2. That is, it is preferable that the heat-seal portion HS1 and the heat-seal portion HS2 do not lead to the front surface portion 28. Accordingly, the bend line 22*a* of the bottom member 22A is in a state of being not fixed to the front surface portion 28 of the barrel portion 20. Therefore, since the upper portion of the bottom portion 22 easily spreads in the vicinity of the side edges 23*a* and 23*b* of the spout-equipped packaging bag 1 and parts in the vicinity of the side edges 23*a* and 23*b* of the barrel portion 20 easily spread in accordance therewith, self-standing stability is improved, and favorable appearance is easily obtained.

Figure 13:
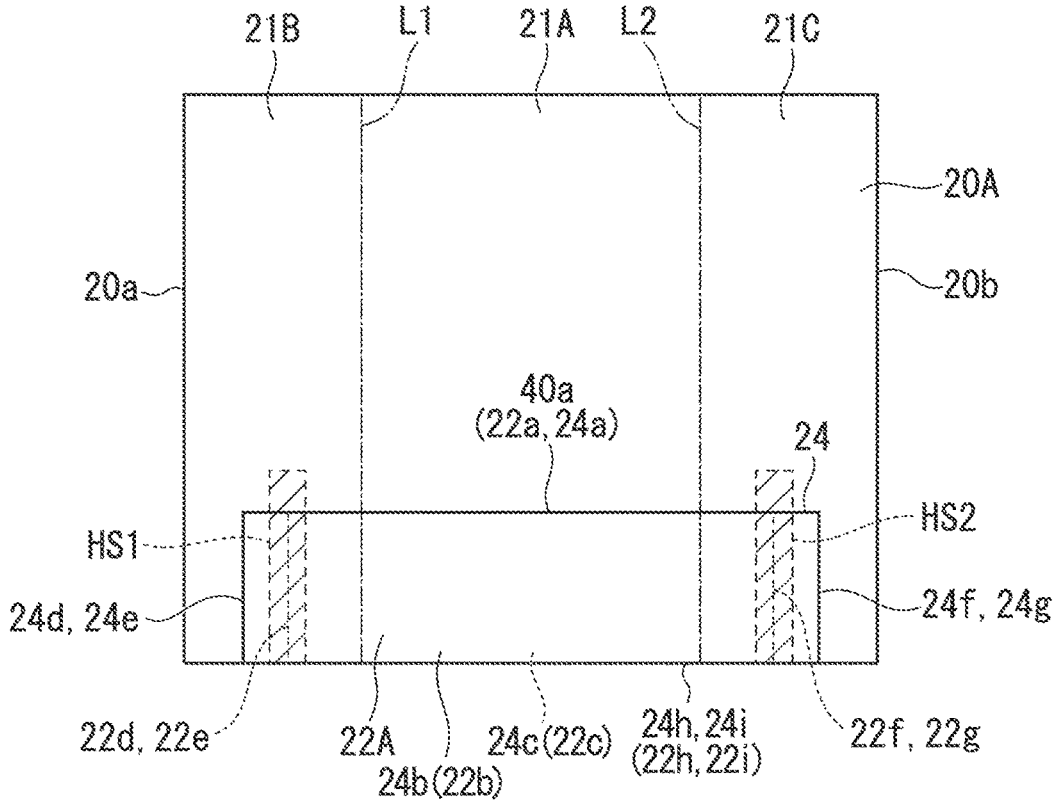
FIG. 13 is a plan view illustrating one manufacturing step in another example of the spout-equipped packaging bag of the present invention.

When the heat-seal portion HS1 and the heat-seal portion HS2 are formed in only the rear surface portion, as illustrated in FIG. 13, one end of the heat-seal portion HS1 in the width direction does not have to lead to the bend line L1, and one end of the heat-seal portion HS2 in the width direction does not have to lead to the bend line L2. That is, the heat-seal portion HS1 and the heat-seal portion HS2 do not have to lead to the side edges 23*a* and 23*b* of the barrel portion 20. In this case as well, since the upper portion of the bottom portion 22 easily spreads in the vicinity of the side edges 23*a* and 23*b* of the spout-equipped packaging bag 1 and parts in the vicinity of the side edges 23*a* and 23*b* of the barrel portion 20 easily spread in accordance therewith, self-standing stability is improved, and favorable appearance is easily obtained.

Figure 14:
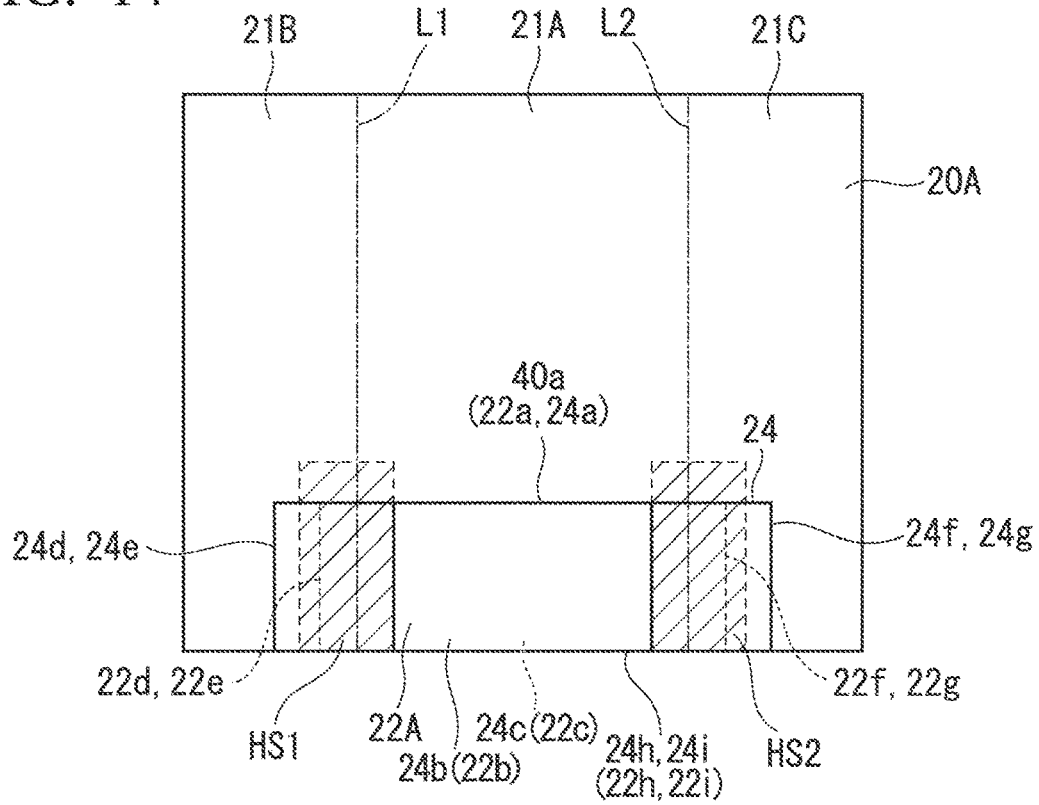
FIG. 14 is a plan view illustrating one manufacturing step in another example of the spout-equipped packaging bag of the present invention.

As long as self-standing stability and design are within a range such that they do not deteriorate, as illustrated in FIG. 14, a form can be adopted in which one ends of the heat-seal portion HS1 and the heat-seal portion HS2 in the width direction leads to the part 21A of the barrel member 20A, that is, the front surface portion of the barrel portion 20 while straddling the bend line L1 and the bend line L2.

The other ends of the heat-seal portions HS1 and HS2 in the width direction need only be positioned on the side ends 20*a* and 20*b* side of the barrel member 20A while respectively straddling the side ends 22*d* and 22*e* and the side ends 22*f* and 22*g* of the bottom member 22A. Accordingly, parts of the adhesive film 24 protruding from the side ends 22*d* and 22*e* of the bottom member 22A are adhered to each other, and parts protruding from the side ends 22*f* and 22*g* are adhered to each other. Therefore, a gap between the side end 22*d* and the side end 22*e* of the bottom member 22A is closed and a gap between the side end 22*f* and the side end 22*g* is closed.

In addition, the other ends of the heat-seal portions HS1 and HS2 in the width direction may be respectively positioned on the side ends 20*a* and 20*b* side of the barrel member 20A beyond the side ends 24*d* and 24*c* and the side ends 24*f* and 24*g* of the adhesive film 24. Accordingly, a gap between the side end 24*d* and the side end 24*e* and a gap between the side end 24*f* and the side end 24*g* are closed. Therefore, contents can be inhibited from entering the gaps therebetween.

In the spout-equipped packaging bag 1, as illustrated in FIGS. 1, 3, 6A, and 6B, when the lower ends 22*h* and 22*i* of the bottom member 22A folded in half and the lower end 20*c* of the barrel member 20A in a tubular shape are heat-scaled throughout the entire circumference of the barrel portion 20, a belt-shaped heat-seal portion HS4 is formed. When the heat-seal portion HS4 reaches the lower edge of the barrel portion 20, its self-standing properties are improved, which is preferable. Accordingly, the opening end on the side below in the spout-equipped packaging bag 1 is closed, and the bottom portion 22 is formed. The width of the belt-shaped heat-seal portion HS4 is preferably within a range of 2 mm to 30 mm and is more preferably within a range of 3 mm to 10 mm.

A part on a side above the heat-seal portion HS4 in the front surface portion 28 of the barrel portion 20 is not adhered to the adhesive film 24. In addition, the first flat surface portion 24*b* and the second flat surface portion 24*c* in the adhesive film 24 being in contact with each other in a bent state are adhered to each other in the heat-seal portion HS4.

In the spout-equipped packaging bag 1, the tubular shape of the bag body 10 when contents are stored has a circular or substantially oval cross section on the bottom portion 22 side and is a tubular shape which may have obtuse corner portions. The upper portion side is in a tubular shape having substantially a rectangular cross section due to the influence of the flange portion 16 of the spout 12.

In addition, in the bag body 10 of the spout-equipped packaging bag 1, the barrel portion 20 has a tubular shape with no side seal portion projecting outward in plan view. Therefore, when the bag body 10 is held with the hand, since the side seal portion does not come into contact with the hand, discomfort is reduced.

The purpose of the spout-equipped packaging bag of the present invention is not particularly limited and can be used as a container for storing contents such as beverages having fluidity or a refillable container, for example.

As described above, in the spout-equipped packaging bag of the present invention, since the bottom portion is formed to block the opening end of a lower part of the barrel portion, when contents are stored, the bottom portion of the bag body spreads and it can stand by itself. In addition, the upper end part of the barrel portion over the entire circumference is in a state of following a shape of the flange portion of the spout in plan view to be in the same shape and is adhered to the upper surface in a folded state, and the spout is attached to the upper portion of the bag body. In other words, in the spout-equipped packaging bag of the present invention, the entire circumference in the upper end part of the tubular barrel portion is liquid-tightly adhered to the upper surface of the flange portion on the spout, and the barrel portion connected to the upper end part includes the bottom portion which is hung down along the shape of a surrounding portion of the flange portion and blocks the opening end of a lower part of the barrel portion. Accordingly, since the shape of the upper portion of the bag body is retained in a spread tubular shape by the flange portion of the spout, even when the amount of contents decreases, the upper portion of the bag body is unlikely to be bent due to the weight of the spout, and therefore sufficient self-standing properties can be ensured.

In addition, in the spout-equipped packaging bag of the present invention, the upper end part of the barrel portion is adhered to the upper surface of the flange portion of the spout in a folded state, and an annular seal portion protruding upward or a Y-shaped hard seal portion on the side part side is not formed in the upper portion of the bag body (refer to the spout-equipped packaging bag in Patent Document 2). Therefore, discomfort when a beverage or the like is stored and a user drinks the beverage or the like through the spout or when the bag body is held with the hand is reduced.

The spout-equipped packaging bag of the present invention is not limited to the foregoing spout-equipped packaging bag 1.

For example, the tubular barrel member is not limited to a tubular member realized by causing side ends of a rectangular barrel member to abut and to be adhered to each other. A tubular film obtained through inflation molding may be used. In addition, the tubular barrel member may be a tubular member realized by combining two or more film materials through heat-sealing or the like. When a barrel portion is formed by combining two or more barrel members, a side seal portion extending in the up-down direction is formed in this barrel portion. However, in this case, it is preferable that this side seal portion in its entirety be folded back and be adhered to a surface of the barrel portion. Accordingly, the side seal portion can be prevented from projecting outward in plan view. Therefore, discomfort when the barrel portion of the bag body is held with the hand is further reduced.

In addition, the barrel member and the bottom member in the bag body may be formed of the same film material, and the barrel member and the bottom member may be integrated.

Figure 15:
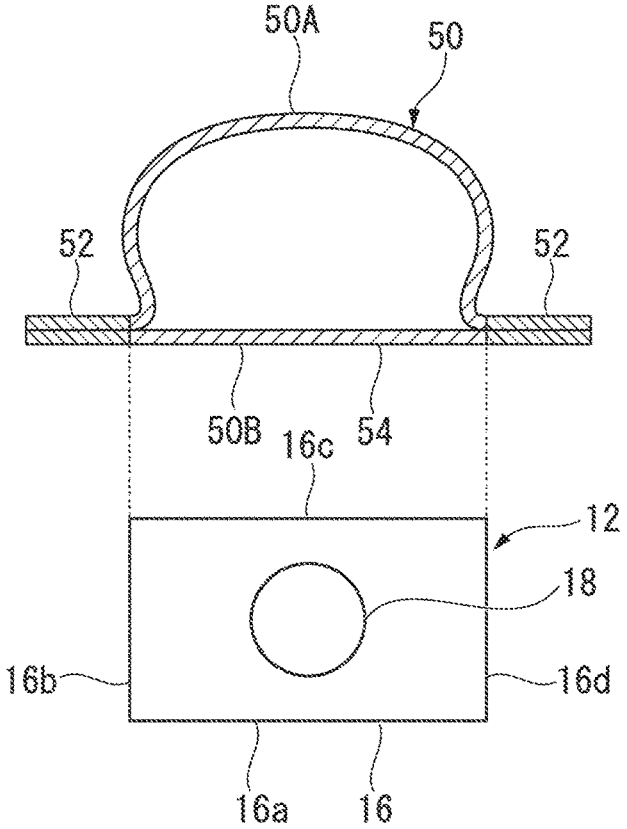
FIG. 15 is a cross-sectional view illustrating a barrel portion in another example of the spout-equipped packaging bag of the present invention.

In the foregoing spout-equipped packaging bag, for example, regarding the barrel portion of the bag body, in place of the barrel portion 20, a bag body including a barrel portion 50 illustrated in FIG. 15 as an example may be provided. The barrel portion 50 is constituted of two barrel members 50A and 50B formed in a tubular shape. The width of the barrel member 50A is larger than the width of the barrel member 50B. Side end portions of the barrel member 50A and the barrel member 501 on one side and side end portions thereof on the opposite side are scaled to each other, and two side seal portions 52 are formed in a tubular shape. The width of a part 54 between two side seal portions 52 in the barrel member 501 of the barrel portion 50 is equivalent to the length of the first side 16*a* in the flange portion 16 of the spout 12. In the barrel portion 50, it is preferable that any one or both of two side seal portions 52 be entirely folded back and be adhered to the part 54 side or to a side opposite thereto.

Even in a spout-equipped packaging bag using the barrel portion 50, the tubular barrel portion constituted of two barrel members 50A and 50B is liquid-tightly adhered to the upper surface of the flange portion of the spout in a folded state, thereby being in a state of following a shape of the flange portion in plan view to be in the same shape. The shape of the upper portion of the bag body is maintained by the flange portion of the spout in a tubular shape in which a cross section spreads in a rectangular shape or the like. Accordingly, even when the amount of contents decreases, the upper portion of the barrel portion 50 is unlikely to be bent due to the weight of the spout, and therefore sufficient self-standing properties can be ensured. In addition, since an annular seal portion protruding upward or a Y-shaped hard seal portion on the side part side is not formed in the upper portion of the bag body (refer to the spout-equipped packaging bag in Patent Document 2), discomfort is also reduced.

In addition, the spout-equipped packaging bag 1 is realized in a form in which the adhesive film 24 is laminated such that the bottom member 22A in its entirety is covered. However, the spout-equipped packaging bag of the present invention may be realized in a form in which adhesive films are laminated such that only both side end portions of the bottom member 22A are covered, respectively.

In the spout-equipped packaging bag 1, the upper end pan 21 of the barrel portion 20 adhered to the upper surface 16*e* of the flange portion 16 is folded such that portions of the second part 21*b* and the fourth part 21*d* overlap the first part 21*a* and the third pan 21*c*. However, the folded form of the upper end part 21 is not limited to this form. For example, a form in which the upper end part 21 of the barrel portion 20 is folded such that portions of the second part 21*b* and the fourth part 21*d* overlap the first part 21*a*, and a portion of the third part 21*c* overlaps the second part 21*b* and the fourth part 21*d* may be adopted. In addition, a form in which the upper end part 21 of the barrel portion 20 is folded such that a portion of the second part 21*b* overlaps the first part 21*a*, a portion of the third part 21*c* overlaps the second part 21*b*, and a portion of the fourth part 21*d* overlaps the first part 21*a* and the third part 21*c* may be adopted.

[Spout-Equipped Packaging Bag that Contains Contents]

The spout-equipped packaging bag that contains contents of the present invention is a spout-equipped packaging bag of the present invention in which contents are stored inside of the bag body. Contents are not particularly limited. Examples of contents include food such as weaning food and liquid food, seasonings, beverages, and contents such as shampoo, conditioner, and body soap having fluidity.

[Manufacturing Method for Spout-Equipped Packaging Bag]

The manufacturing method for a spout-equipped packaging bag of the present invention is a manufacturing method for a self-standing spout-equipped packaging bag including the bag body that stores contents, and the spout that is attached to the upper portion of the bag body. The bag body includes the tubular barrel portion, and the bottom portion which is attached to block the opening end of a lower part of the barrel portion. In the manufacturing method for a spout-equipped packaging bag of the present invention, the spout including the tubular nozzle portion, and the flange portion which protrudes from the outer surface of the nozzle portion is used such that the upper end part of the tubular barrel portion over the entire circumference is folded on the upper surface of the flange portion and is liquid-tightly adhered to this upper surface in a state of following the shape of the flange portion in plan view to be in the same shape.

According to the manufacturing method for a spout-equipped packaging bag of the present invention, the foregoing spout-equipped packaging bag of the present invention can be manufactured.

Hereinafter, as an example of the manufacturing method for a spout-equipped packaging bag, a manufacturing method for the foregoing spout-equipped packaging bag 1 will be described. The manufacturing method for the spout-equipped packaging bag 1 has the following steps (a) and (b).

(a) A step of attaching the bottom member 22A folded in half to a part below inside of the barrel member 20A while having the bend line 22*a* above, and forming the bag body 10 in which the opening end below the tubular barrel portion 20 is closed by the bottom portion 22

(b) The upper end part 21 of the tubular barrel portion 20 is folded on the upper surface 16*e* of the flange portion 16 in the spout 12 and is liquid-tightly adhered thereto in a state of following the shape of the flange portion in plan view to be in the same shape, and the spout 12 is attached to the upper portion of the bag body 10.

(Step (a))

For example, step (a) can be performed through the following steps (a1) to (a6).

(a1) A step of forming a laminated body 40 by laminating the bottom member 22A and the adhesive film 24 such that both the side ends 24*d* and 24*e* and the side ends 24*f* and 24*g* of the adhesive film 24 in the width direction respectively protrude in the width direction from both the side ends 22*d* and 22*e* and the side ends 22*f* and 22*g* of the bottom member 22A (a2) A step of folding the laminated body 40 in half on a bend line 40*a* extending in the width direction such that the adhesive film 24 is on the outer side (a3) A step of mounting the laminated body 40 folded in half on the rectangular barrel member 20A (a4) A step of attaching the side ends 22*d* and 22*e* and the side ends 22*f* and 22*g* of the bottom member 22A to the barrel member 20A by means of the adhesive film 24

(a5) A step of forming a tubular shape by causing the side ends 20*a* and 20*b* of the barrel member 20A to be adhered to each other such that the surface to which the bottom member 22A of the barrel member 20A is attached becomes the inner surface, thereby forming the barrel portion 20

(a6) A step of forming the bottom portion 22 by causing the lower ends 22*h* and 22*i* of the bottom member 22A and the lower end 20*c* side of the barrel portion 20 to be adhered to each other throughout the entire circumference of the barrel portion 20

Step (a1):

As illustrated in FIG. 4A, the laminated body 40 is formed by laminating the bottom member 22A and the adhesive film 24 such that both the side ends 24*d* and 24*e* and the side ends 24*f* and 24*g* of the adhesive film 24 respectively protrude in the width direction from both the side ends 22*d* and 22*e* and the side ends 22*f* and 22*g* of the bottom member 22A. When the bottom member 22A has the sealant layer, the sealant layer of the bottom member 22A are laminated to face the adhesive film 24 side.

In step (a1), it is preferable that the laminated body 40 be formed by causing the bottom member 22A and the adhesive film 24 to be partially adhered to each other along both the side ends 22*d* and 22*e* and the side ends 22*f* and 22*g* of the bottom member 22A, respectively. In this manner, when the laminated body 40 is formed, control of the positional relationship between the bottom member 22A and the adhesive film 24 is further facilitated. Even if the size is small, it is possible to more stably obtain the spout-equipped packaging bag 1 in which leakage of contents is inhibited.

The bottom member 22A and the adhesive film 24 may be adhered to each other through heat-sealing and may be adhered to each other by another method using an adhesive or the like.

Step (a2):

Next, as illustrated in FIG. 4A, the laminated body 40 is folded in half along the bend line 40*a* extending in the width direction such that the adhesive film 24 is on the outer side.

The bend line 40*a* of the laminated body 40 extending in the width direction coincides with the bend line 22*a* of the bottom member 22A and the bend line 24*a* of the laminated film. In the bottom member 22A of the laminated body 40 folded in half, the bend line 22*a* folded in half is caused to be the upper end, the side end 22*d* of the first bottom surface portion 22*b* and the side end 22*e* of the second bottom surface portion 22*c* are caused to coincide with each other, the side end 22*f* of the first bottom surface portion 22*b* and the side end 22*g* of the second bottom surface portion 22*c* are caused to coincide with each other, and the lower end 22*h* of the first bottom surface portion 22*b* and the lower end 22*i* of the second bottom surface portion 22*c* are caused to coincide with each other. In the adhesive film 24 of the laminated body 40 folded in half as well, the bend line 24*a* folded in half is caused to be the upper end, the side end 24*d* of the first flat surface portion 24*b* and the side end 24*e* of the second flat surface portion 24*c* are caused to coincide with each other, the side end 24*f* of the first flat surface portion 24*b* and the side end 24*g* of the second flat surface portion 24*c* are caused to coincide with each other, and the lower end 24*h* of the first flat surface portion 24*b* and the lower end 24*i* of the second flat surface portion 24*c* are caused to coincide with each other.

Step (a3):

Next, as illustrated in FIG. 4B, the laminated body 40 folded in half is mounted on the sealant layer of the rectangular barrel member 20A. At this time, it is preferable that a side opposing the bend line 40*a* in the laminated body 40, that is, the lower ends 22*h* and 22*i* of the bottom member 22A and the lower ends 24*h* and 24*i* of the adhesive film 24 when the spout-equipped packaging bag 1 is realized coincide with the lower end 20*c* of the barrel member 20A when the spout-equipped packaging bag 1 is realized. In addition, in this example, in the laminated body 40, the side ends 22*d* and 22*e* of the bottom member 22A are caused to be positioned in the part 21B on the side end 20*a* side from the bend line L1 on which the barrel member 20A is bent. Similarly, the side ends 22*f* and 22*g* of the bottom member 22A are disposed to be positioned in the part 21C on the side end 20*b* side from the bend line L2 on which the barrel member 20A is bent.

When the laminated body 40 is disposed on the barrel member 20A, the barrel member 20A and the laminated body 40 may be temporarily adhered to each other. It is preferable that the position for temporary adhesion be a position overlapping any of the heat-seal portions HS1, HS2, and HS4 formed afterward.

Step (a4):

As illustrated in FIG. 43, the heat-seal portion HS1 is formed by performing heat-sealing between the laminated body 40 and the barrel member 20A in the part 21B of the barrel member 20A beyond the upper end of the bottom member 22A such that all the side ends 22*d* and 22*e* of the bottom member 22A are included from the bend line 22*a* to the lower ends 22*h* and 22*i*. In the heat-seal portion HS1, the adhesive film 24 and the bottom member 22A are adhered to each other, the adhesive film 24 and the part 21B of the barrel member 20A are adhered to each other, and parts of the adhesive film 24 protruding from the bottom member 22A are adhered to each other. Accordingly, the side ends 22*d* and 22*e* of the bottom member 22A are closed by the adhesive film 24 and are attached to a part on the sealant layer of the part 21B of the barrel member 20A through adhesion. The surface of the barrel member 20A on the sealant layer side becomes the inner surface of the barrel portion 20 when the spout-equipped packaging bag 1 is realized. Since the base material layers are contacted to each other, the side ends 22*d* and 22*e* of the bottom member 22A are not adhered to each other.

Similarly, the heat-seal portion HS2 is formed by performing heat-sealing between the laminated body 40 and the barrel member 20A in the part 21C of the barrel member 20A beyond the upper end of the bottom member 22A such that all the side ends 22*f* and 22*g* of the bottom member 22A are included from the bend line 22*a* to the lower ends 22*h* and 22*i*. In the heat-seal portion HS2, the adhesive film 24 and the bottom member 22A are adhered to each other, the adhesive film 24 and the part 21C of the barrel member 20A are adhered to each other, and parts of the adhesive film 24 protruding from the bottom member 22A are adhered to each other. Accordingly, the side ends 22*f* and 22*g* of the bottom member 22A are closed by the adhesive film 24 and are attached to a part on the sealant layer of the part 21C of the barrel member 20A through adhesion. The surface of the barrel member 20A on the sealant layer side becomes the inner surface of the barrel portion 20 when the spout-equipped packaging bag 1 is realized. Since the base material layers are adhered to each other, the side ends 22*f* and 22*g* of the bottom member 22A are not adhered to each other.

Step (a5):

The side end 20*a* side and the side end 20*b* side of the barrel member 20A are bent together with the bottom member 22A and the side end side of the adhesive film 24 along the bend lines L1 and L2 positioned on the middle side from both the side ends 22*d* and 22*e* and the side ends 22*f* and 22*g* of the bottom member 22A such that the surface to which the bottom member 22A of the barrel member 20A is attached becomes the inner surface. As such, they can be easily bent by causing one ends of the heat-seal portions HS1 and HS2 in the width direction to coincide with the bend lines L1 and L2. Next, as illustrated in FIG. 5A, the side end 20*a* and the side end 20*b* are caused to abut each other, the adhesive film 26 overlaps the inner surfaces thereof, and the heat-seal portion HS3 is formed through heat-sealing, thereby forming the back joint 25. Accordingly, the tubular barrel portion 20 is formed.

Step (a6):

The bottom portion 22 is formed by performing heat-sealing between the lower ends 22*h* and 22*i* of the bottom member 22A and the lower end 20*c* side of the barrel portion 20 throughout the entire circumference of the barrel portion 20 to realize the heat-scale portion HS4. As illustrated in FIG. 6A, in the stepped part in a region c in which the side end. 22*d* and 22*e* of the bottom member 22A are positioned in the heat-seal portion HS4, in order to enhance the effect of inhibiting an adhesive failure, it is preferable to perform point sealing which is sealing stronger than heat-sealing of the heat-seal portion HS4, in addition to heat-sealing of the heat-seal portion HS4. Similarly, in the stepped part in a region in which the side ends 22*f* and 22*g* of the bottom member 22A are positioned in the heat-seal portion HS4 as well, in order to enhance the effect of inhibiting an adhesive failure, it is preferable to perform point sealing, in addition to heat-sealing of the heat-seal portion HS4.

(Step (b))

For example, step (b) can be performed through the following steps (b1) to (b5).

(b1) The cut-out portion 19 is formed in the first part 21*a* and the third part 21*c* in the upper end part 21 of the barrel portion 20 of the bag body 10 obtained in step (a), that is, the front surface portion 28 and the rear surface portion 30 of the bag body 10 in a flat state, and the ruled lines 48 and 49 constituted of recessed bars for assisting folding of the upper end part 21 are formed on the front surface portion 28 and the rear surface portion 30 of the bag body 10 in a flat state.

(b2) The flange portion 16 of the spout 12 is inserted into the upper portion of the barrel portion 20 through the opening of the bag body 10 on the upper side, and the first part 21*a* of the upper end part 21 of the barrel portion 20 is bent along the first side 16*a* of the flange portion 16 and is heat-sealed to the upper surface 16*e* of the flange portion 16.

(b3) The third part 21*c* of the upper end part 21 of the barrel portion 20 is bent along the third side 16*c* of the flange portion 16 and is heat-sealed to the upper surface 16*e* of the flange portion 16.

(b4) The second part 21*b* and the fourth part 21*d* of the upper end part 21 of the barrel portion 20 are bent along the second side 16*b* and the fourth side 16*d* of the flange portion 16 respectively and are heat-sealed to the upper surface 16*e* of the flange portion 16.

(b5) Heat-sealing is performed again with respect to the upper end part 21 of the barrel portion 20 in its entirety in a state of being folded on the upper surface 16*e* of the flange portion 16.

Figure 8:
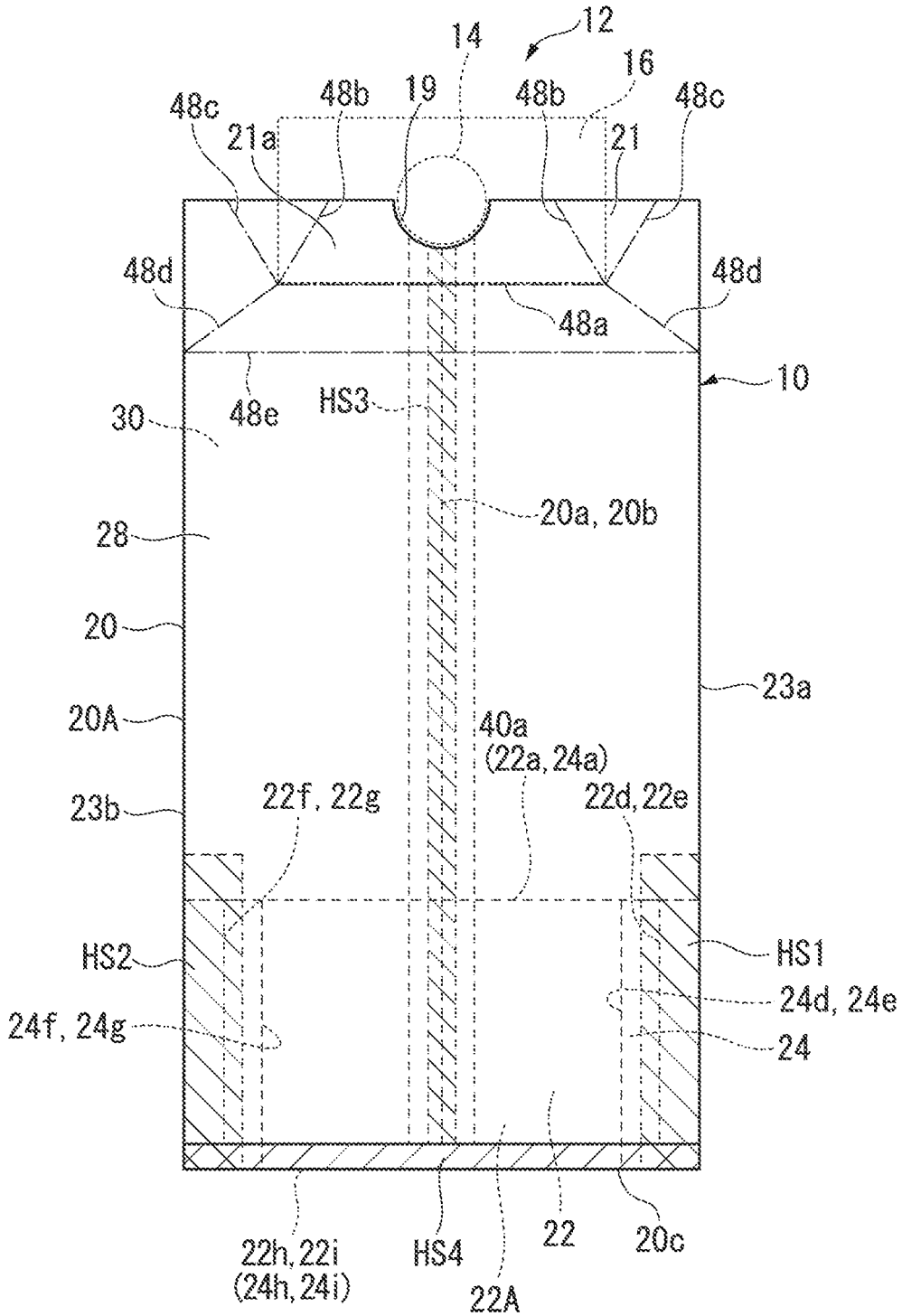
FIG. 8 is a view illustrating one manufacturing step for the spout-equipped packaging bag of the present invention and is a front view of the bag body before the spout is attached.
Figure 9:
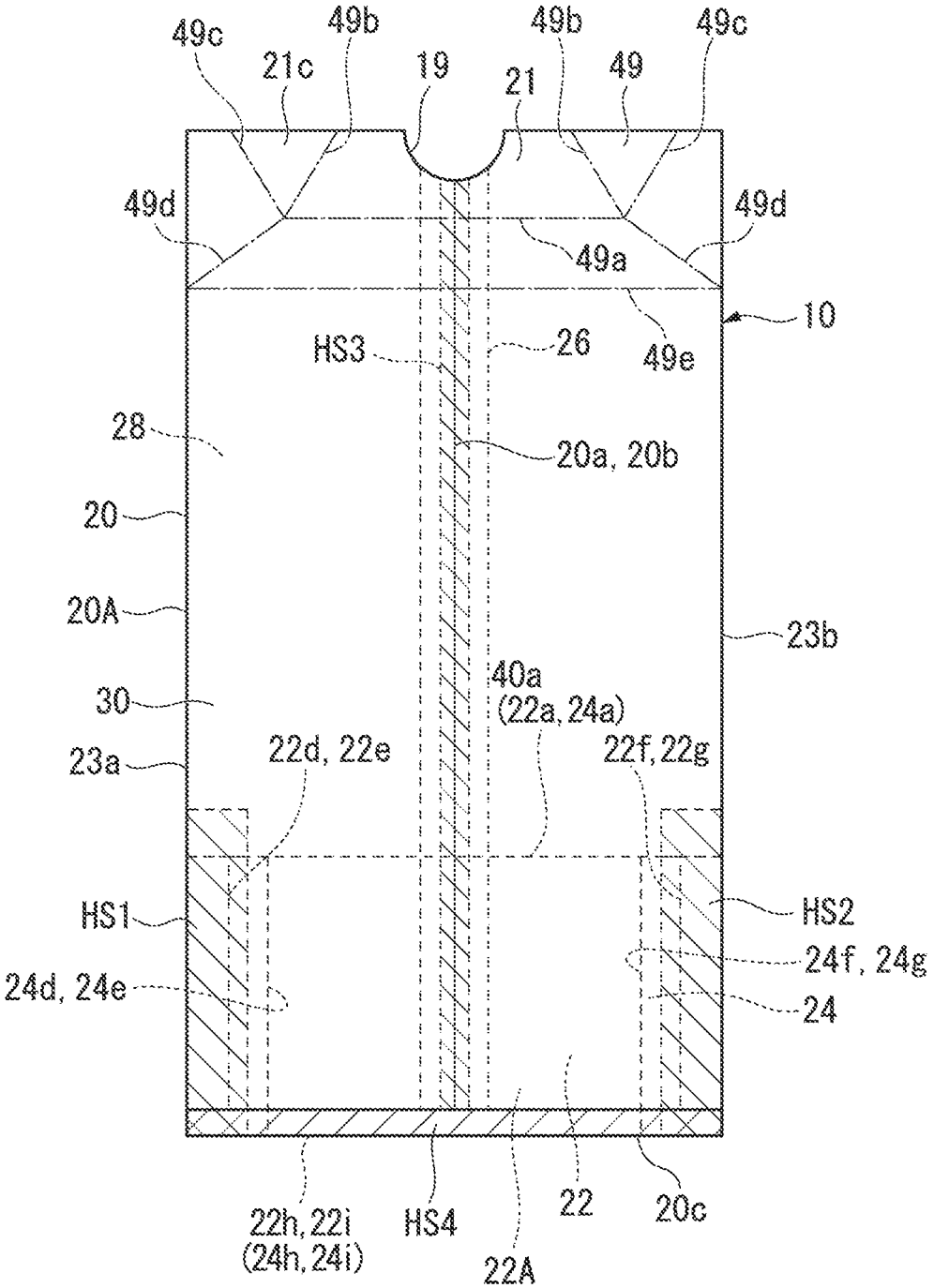
FIG. 9 is a view illustrating one manufacturing step for the spout-equipped packaging bag of the present invention and is a rear view of the bag body before the spout is attached.

Step (b1):

As illustrated in FIGS. 8 and 9, the semicircular cut-out portion 19 is formed such that the position of the nozzle portion 14 corresponds thereto when the spout 12 is attached to both the first part 21*a* and the third part 21*c* in the upper end part 21 of the barrel portion 20 of the bag body 10 obtained through step (a). The method for forming the cut-out portion 19 by partially cutting out the upper end part 21 of the barrel portion 20 is not particularly limited, and a known method can be utilized.

In addition, the ruled lines 48 and 49 constituted of recessed bars for assisting the upper end part 21 are formed in parts which are bent when the upper end part 21 is folded on the upper surface 16*e* of the flange portion 16 of the spout 12 in the front surface portion 28 and the rear surface portion 30 of the bag body 10 in a flat state.

The ruled line 48 is formed in the upper portion of the front surface portion 28 and has the first ruled line 48*a*, second ruled lines 48*b* and 48*b*, third ruled lines 48*c* and 48*c*, fourth ruled lines 48*d* and 48*d*, and a fifth ruled line 48*e*. The first ruled line 48*a* is a line for assisting bending along the first side 16*a* of the flange portion 16 and is formed to extend linearly in the width direction of the front surface portion 28. The length of the first ruled line 48*a* is equivalent to the length of the first side 16*a* of the flange portion 16, and the middle of the first ruled line 48*a* coincides with the middle of the width direction of the front surface portion 28. The second ruled lines 48*b* and 48*b* are lines for assisting bending of the first part 21*a* of the upper end part 21 in a trapezoidal shape and are formed linearly to the upper edge of the front surface portion 28 by being inclined from both ends of the first ruled line 48*a* toward the middle side in the width direction. Third ruled lines 48*c* and 48*c* are lines for assisting bending of the second part 21*b* and the fourth pan 21*d* of the upper end part 21 in a trapezoidal shape and are formed linearly to the upper edge of the front surface portion 28 by being inclined from both ends of the first ruled line 48*a* toward the side end side. The fourth ruled lines 48*d* and 48*d* are formed to the side edges 23*a* and 23*b* of the front surface portion 28 by being inclined downward from both ends of the first ruled line 48*a*. The fifth ruled line 48*e* is formed linearly in the width direction such that the lower ends of two fourth ruled lines 48*d* and 48*d* are connected to each other.

The ruled line 49 is formed in the upper portion of the rear surface portion 30 into a shape similar to that of the ruled line 48 and has a first ruled line 49*a*, second ruled lines 49*b* and 49*b*, third ruled lines 49*c* and 49*c*, fourth ruled lines 49*d* and 49*d*, and a fifth ruled line 49*e*. The first ruled line 49*a* is a line for assisting bending along the third side 16*c* of the flange portion 16 and is formed to extend linearly in the width direction of the rear surface portion 30. The length of the first ruled line 49*a* is equivalent to the length of the third side 16*c* of the flange portion 16, and the middle of the first ruled line 49*a* coincides with the middle of the rear surface portion 30 in the width direction.

The second ruled lines 49*b* and 49*b* are lines for assisting bending of the third part 21*c* of the upper end part 21 into a trapezoidal shape and are formed linearly to the upper edge of the rear surface portion 30 by being inclined from both ends of the first ruled line 49*a* toward the middle side in the width direction. The third ruled lines 49*c* and 49*c* are lines for assisting bending of the second part 21*b* and the fourth part 21*d* of the upper end part 21 into a trapezoidal shape and are formed linearly to the upper edge of the rear surface portion 30 by being inclined from both ends of the first ruled line 49*a* toward the side end side. The fourth ruled lines 49*d* and 49*d* are formed to the side edges 23*a* and 23*b* by being inclined downward from both ends of the first ruled line 49*a*. The fifth ruled line 49*e* is formed linearly in the width direction such that the lower ends of two fourth ruled lines 49*d* and 49*d* are connected to each other. However, it is not used for folding in the manufacturing method of the present embodiment.

The method for forming the ruled lines 48 and 49 is not particularly limited. Examples thereof include a method in which a cutter is pressed against a surface of the barrel member 20A. The ruled lines 48 and 49 may be formed on the inner surface of the barrel portion 20 or may formed on the outer surface.

Step (b2):

The flange portion 16 is inserted into an opening between the front surface portion 28 and the rear surface portion 30 of the barrel portion 20 from the upper portion of the bag body 10 while having the nozzle portion 14 of the spout 12 on the front surface portion 28 side and the first side 16*a* (long side of the flange portion 16) as the distal end. The flange portion 16 is inserted by performing positioning such that the position of the cut-out portion 19 matches the position of the nozzle portion 14 of the spout 12, and the first side 16*a* matches the first ruled line 48*a*. Thereafter, the base overlaps the first side 16*a*, and the heat-seal portion HS5*a* is formed by heat-sealing the first part 21*a* of the barrel portion 20 to the upper surface 16*e* of the flange portion 16 such that the shape in plan view becomes an isosceles trapezoid except for the cut-out portion 19 while having the second ruled lines 48*b* and 48*b* as oblique sides.

After the heat-seal portion HS5*a* is formed, the upper portion of the barrel portion 20 is bent utilizing the fourth ruled lines 48*d*. 48*d*, 49*d*, and 49*d* and the fifth ruled line 48*e* such that triangular parts 27*a* and 27*b* are formed on the second side 16*b* side and the fourth side 16*d* side of the flange portion 16 of the spout 12.

Figure 10A:
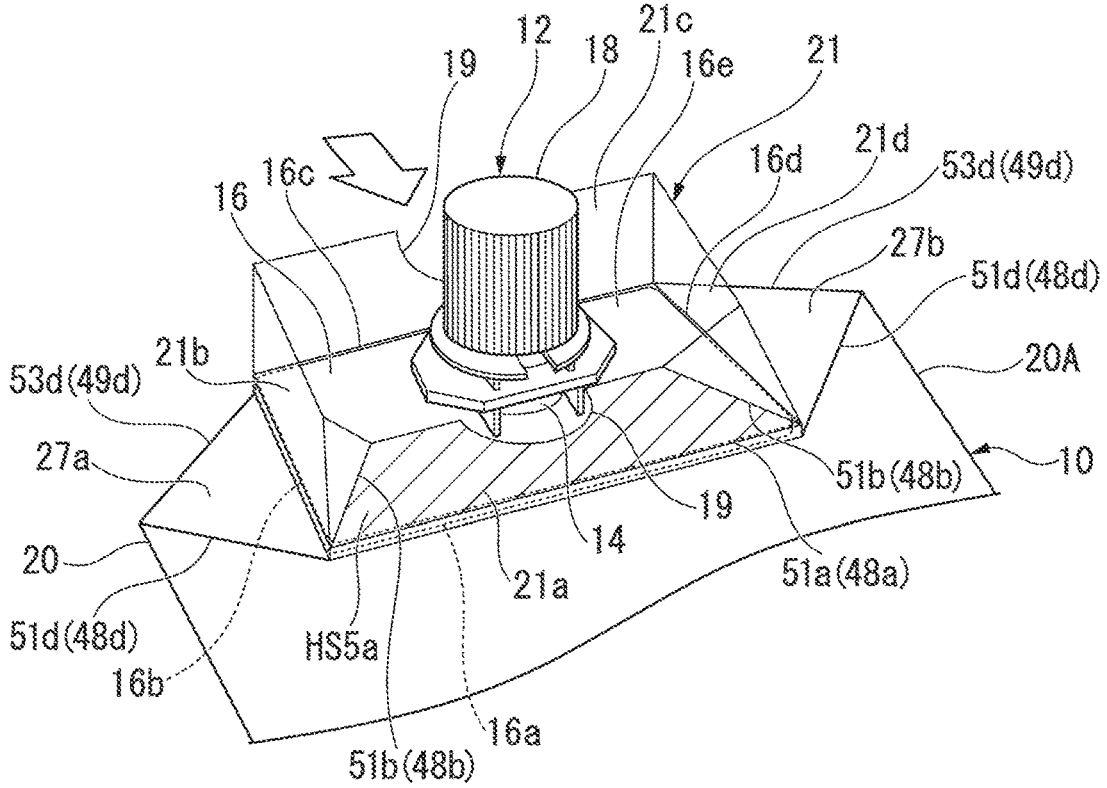
FIG. 10A is an example of one manufacturing step and is a perspective view illustrating a situation in which an upper end part of a tubular barrel portion over the entire circumference is folded and is adhered to an upper surface of a flange portion of the spout.

That is, the flange portion 16 is moved in a direction of the lower portion of the bag body 10 while holding up the flange portion 16 on the front surface portion 28 side. As illustrated in FIG. 10A, a bend line 51*a* is formed by folding the fifth ruled line 48*e* downward and folding the first ruled line 48*a* upward. In addition, the second ruled lines 48*b* and 48*b* are also folded downward during this movement to form bend lines 51*b* and 51*b*, the third ruled lines 48*c* and 48*c* are also folded upward to form bend lines 51*c* and 51*c*, and the fourth ruled lines 48*d* and 48*d* are folded upward to form bend lines 51*d* and 51*d*. In this manner, when the flange portion 16 is moved in a direction of the lower portion of the bag body 10 while holding up the flange portion 16 on the front surface portion 28 side, all the first to fifth ruled lines of the front surface portion 28 are bent.

Figure 10B:
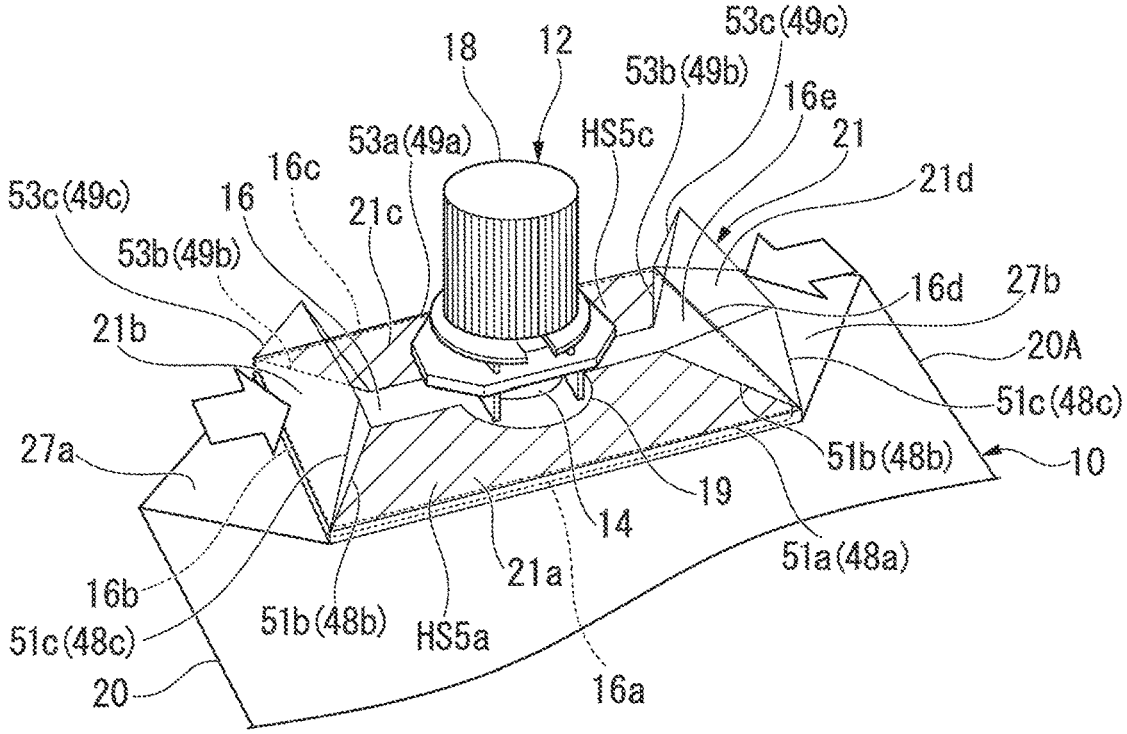
FIG. 10B is the example of one manufacturing step and is a perspective view illustrating a situation in which the upper end part of the tubular barrel portion over the entire circumference is folded and is adhered to the upper surface of the flange portion of the spout.

The barrel portion 20 of the spout-equipped packaging bag 1 illustrated in FIG. 10A is in a state of being folded into a flat shape. In the spout 12, the flange portion 16 is in a state of being disposed to be parallel to the front surface portion 28 and the rear surface portion 30 of the barrel portion 20. Hereinafter, the same applies to FIGS. 10B, 11, and 12.

Step (b3):

As indicated with an arrow in FIG. 10A, the third part 21*c* of the upper end part 21 of the barrel portion 20 is bent along the third side 16*c* of the flange portion 16 utilizing the first ruled line 49*a* of the rear surface portion 30 and is further bent utilizing the second ruled lines 49*b* and 49*b* such that the shape in plan view becomes a trapezoidal shape, and the heat-seal portion HS5*c* is formed by heat-sealing the third part 21*c* to the upper surface 16*e* of the flange portion 16. A bend line 53*a* bent along the third side 16*c* of the flange portion 16 in the third part 21*c* of the upper end part 21 coincides with the first ruled line 49*a*. In addition, inclined bend lines 53*b* and 53*b* of the third part 21*c* bent into a trapezoidal shape coincide with the second ruled lines 49*b* and 49*b*.

Step (b4):

The second part 21*b* of the upper end pan 21 of the barrel portion 20 is bent along the second side 16*b* of the flange portion 16 such that a portion of the second part 21*b* overlaps the first part 21*a* and the third part 21*c* and is further bent utilizing the third ruled lines 48*c* and 49*c* such that the shape in plan view becomes a trapezoidal shape, and the heat-seal portion HS5*b* is formed by heat-sealing the second pan 21*b* to the upper surface 16*e* of the flange portion 16. Similarly, the fourth part 21*d* of the upper end part 21 of the barrel member 20A is bent along the fourth side 16*d* of the flange portion 16 such that a portion of the fourth part 21*d* overlaps the first part 21*a* and the third part 21*c* and is further bent utilizing the fourth ruled lines 48*d* and 49*d* such that the shape in plan view becomes a trapezoidal shape, and the heat-seal portion HS5*d* is formed by heat-sealing the fourth part 21*d* to the upper surface 16*e* of the flange portion 16. The inclined bend lines 51*c* and 53*c* of the second part 21*b* bent into a trapezoidal shape coincide with the third ruled lines 48*c* and 49*c*. The inclined bend lines 51*c* and 53*c* of the fourth part 21*d* bent into a trapezoidal shape coincide with the third ruled lines 48*c* and 49*c*.

Regarding adhesion of the second part 21*b* of the upper end part 21 of the barrel portion 20 to the upper surface 16*e* of the flange portion 16 and adhesion of the fourth part 21*d* of the upper end part 21 of the barrel portion 20 to the upper surface 16*e* of the flange portion 16, either may be performed first or they may be performed at the same time.

In steps (b2) to (b4), the upper end part 21 of the tubular barrel portion 20 is liquid-tightly adhered to the upper surface 16*e* of the flange portion 16 in the spout 12 in a folded state, thereby obtaining the spout-equipped packaging bag 1 in which the spout 12 is attached to the upper portion of the bag body 10.

Step (b5):

Heat-sealing is performed again with respect to the upper end part 21 of the barrel portion 20 in its entirety in a state of being folded on the upper surface 16*e* of the flange portion 16. Accordingly, the upper end part 21 of the tubular barrel portion 20 is reliably liquid-tightly adhered to the upper surface 16*e* of the flange portion 16 in the spout 12 in a folded state.

In the manufacturing method for a spout-equipped packaging bag of the present invention, as in the flange portion 16 of the present embodiment in which the shape in plan view is substantially a rectangular shape, when the shape of the flange portion of the spout in plan view is substantially a polygonal shape, it is preferable that an operation in which a portion of the upper end part of the barrel member is bent along one side of the flange portion and is adhered to the upper surface of the flange portion be repetitively performed for each of the sides and the upper end part of the barrel member in its entirety be liquid-tightly adhered to the upper surface of the flange portion. Accordingly, manufacturing of the spout-equipped packaging bag is facilitated.

It is preferable that the number of times of folding the upper end part of the barrel member be the same as the number of sides of the flange portion.

In addition, in the present invention, as in the foregoing spout-equipped packaging bag 1, it is more preferable that after respective pans of the upper end part of the barrel member are bent along every other side of a plurality of sides of the flange portion and are adhered to the upper surface of the flange portion, the remaining parts of the upper end part of the barrel member be bent along the remaining sides of the flange portion and be adhered to the upper surface of the flange portion.

According to the manufacturing method for a spout-equipped packaging bag of the present invention, it is possible to obtain a spout-equipped packaging bag in which the upper end part of the tubular barrel portion of the bag body follows the shape of the flange portion in plan view to be in the same shape, sufficient self-standing properties can be ensured even when the amount of contents decreases, and discomfort when in use is reduced.

The manufacturing method for a spout-equipped packaging bag of the present invention is not limited to the manufacturing method for the foregoing spout-equipped packaging bag 1.

For example, as long as the method is within a range in which the upper end part 21 of the tubular barrel portion 20 can be liquid-tightly adhered to the upper surface 16*e* of the flange portion 16 in the spout 12, a method in which step (b5) is not performed may be adopted.

When the shape of the flange portion of the spout in plan view is substantially a polygonal shape, the manufacturing method for a spout-equipped packaging bag of the present invention may be a method (which will hereinafter be referred to as a method (α)) in which the order of forming the heat-seal portion in steps (b3) and (b4) described above is changed, and after a portion of the upper end part of the barrel portion is bent along one side of the plurality of sides of the flange portion and is adhered to the upper surface of the flange portion, respective parts of the upper end pan of the barrel member are bent along respective sides of the flange portion and are adhered to the upper surface of the flange portion in a sequential order of moving round in one direction in plan view.

Figure 11A:
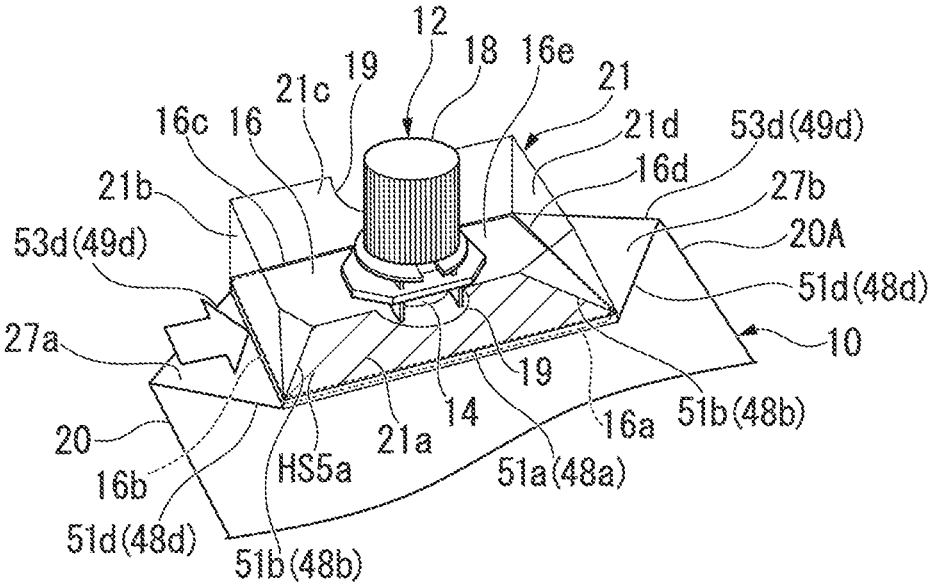
FIG. 11A is the example of one manufacturing step and is a perspective view illustrating a situation in which the upper end part of the tubular barrel portion over the entire circumference is folded and is adhered to the upper surface of the flange portion of the spout.
Figure 11B:
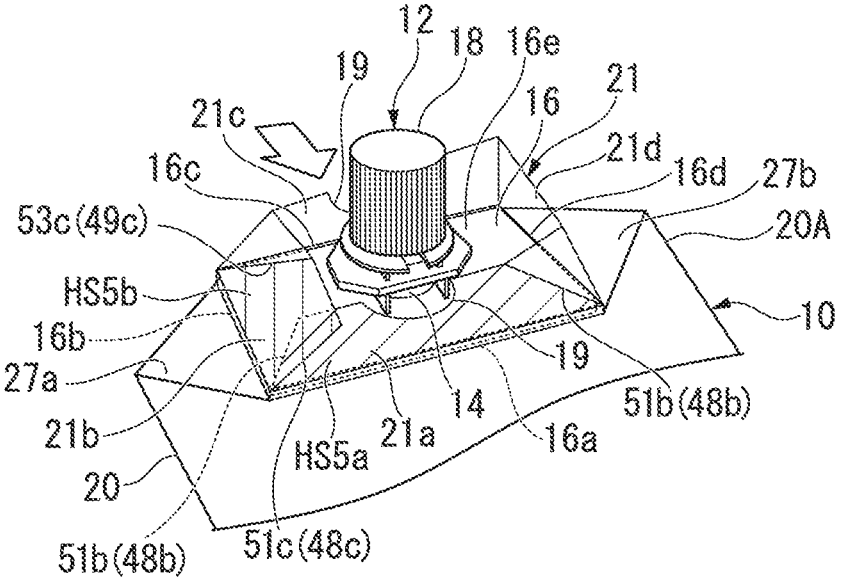
FIG. 11B is the example of one manufacturing step and is a perspective view illustrating a situation in which the upper end part of the tubular barrel portion over the entire circumference is folded and is adhered to the upper surface of the flange portion of the spout.
Figure 11C:
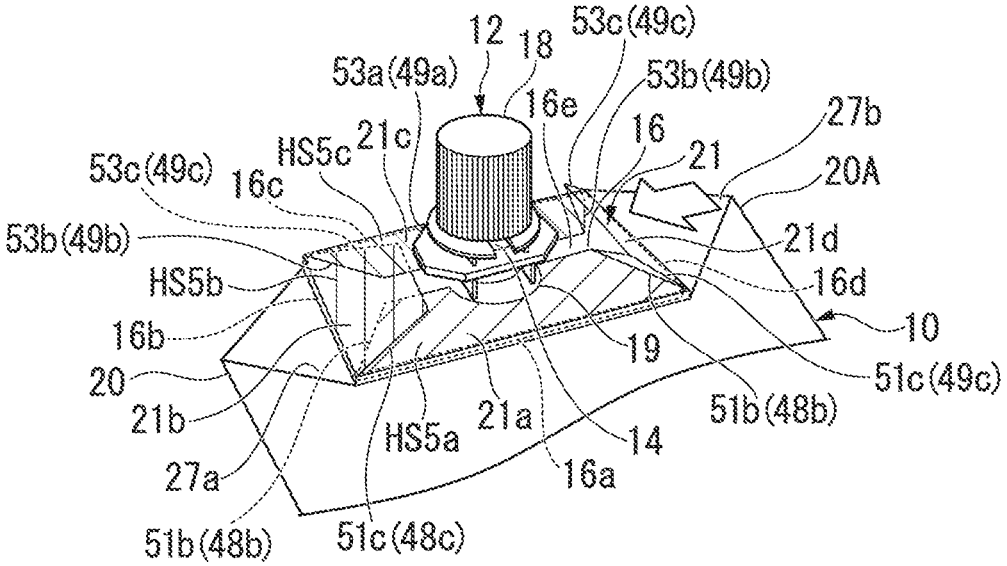
FIG. 11C is the example of one manufacturing step and is a perspective view illustrating a situation in which the upper end part of the tubular barrel portion over the entire circumference is folded and is adhered to the upper surface of the flange portion of the spout.

Regarding the method (α), for example, when the spout 12 is used, the upper end part 21 of the tubular barrel portion 20 may be folded and be liquid-tightly adhered to the upper surface 16*e* of the flange portion 16 as follows. Specifically, similar to step (b2) described above, the heat-seal portion HS5*a* is formed as illustrated in FIG. 11A. Next, it is folded in a direction of the arrow in FIG. 11A. Then, as illustrated in FIG. 118, the second part 21*b* of the upper end part 21 of the barrel portion 20 is bent along the second side 16*b* of the flange portion 16 such that a portion of the second part 21*b* overlaps the first part 21*a*. The second part 21*b* is bent utilizing the third ruled lines 48*c* and 49*c* such that the shape in plan view becomes a trapezoidal shape. The heat-seal portion HS5*b* is formed by heat-sealing the second part 21*b* to the upper surface 16*c* of the flange portion 16. Next, it is folded in a direction of the arrow in FIG. 11B. Then, as illustrated in FIG. 11C, the third part 21*c* of the upper end part 21 of the barrel portion 20 is bent along the third side 16*c* of the flange portion 16 such that a portion of the third part 21*c* overlaps the second part 21*b* utilizing the first ruled line 49*a*. The third part 21*c* is bent utilizing the second ruled lines 49*b* and 49*b* such that the shape in plan view becomes a trapezoidal shape, and the heat-seal portion HS5*c* is formed by heat-scaling the third part 21*c* to the upper surface 16*e* of the flange portion 16. Next, it is folded in a direction of the arrow in FIG. 11C. Then, the fourth part 21*d* of the upper end part 21 of the barrel portion 20 is bent along the fourth side 16*d* of the flange portion 16 such that a portion of the fourth part 21*d* overlaps the third pan 21*c*. The fourth part 21*d* is bent utilizing the third ruled lines 48*c* and 49*c* such that the shape in plan view becomes a trapezoidal shape, and the heat-seal portion HS5*d* is formed by heat-sealing the fourth part 21*d* to the upper surface 16*e* of the flange portion 16.

In addition, the manufacturing method for a spout-equipped packaging bag of the present invention may be a method (which will hereinafter be referred to as a method (β) in which the order of forming the heat-seal portion in steps (b3) and (b4) described above is changed, and after a portion of the upper end part of the barrel portion is bent along one side of the plurality of sides of the flange portion and is adhered to the upper surface of the flange portion, respective parts of the upper end part of the barrel portion are bent along respective sides of the flange portion and are adhered to the upper surface of the flange portion in order of moving halfway round respectively in both directions in plan view.

Figure 12A:
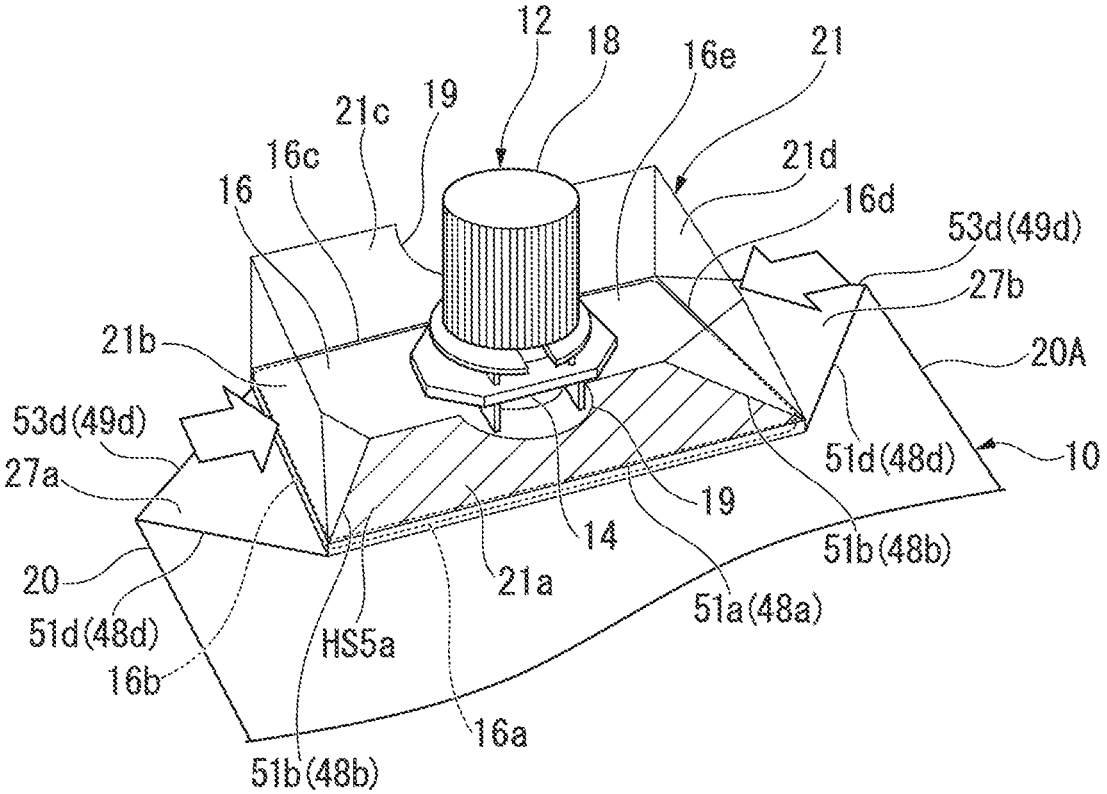
FIG. 12A is the example of one manufacturing step and is a perspective view illustrating a situation in which the upper end part of the tubular barrel portion over the entire circumference is folded and is adhered to the upper surface of the flange portion of the spout.
Figure 12B:
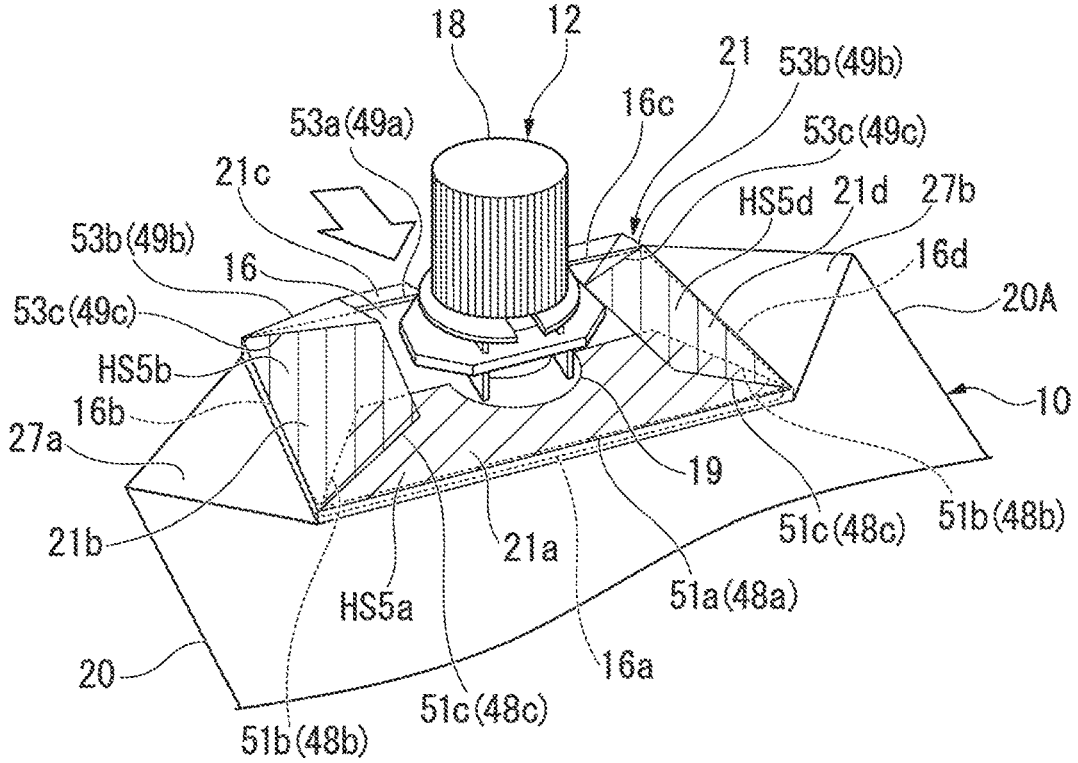
FIG. 12B is the example of one manufacturing step and is a perspective view illustrating a situation in which the upper end part of the tubular barrel portion over the entire circumference is folded and is adhered to the upper surface of the flange portion of the spout.

Regarding the method (β), for example, when the spout 12 is used, the upper end part 21 of the tubular barrel portion 20 may be folded and be liquid-tightly adhered to the upper surface 16*e* of the flange portion 16 as follows. Specifically, similar to step (b2) described above, the heat-seal portion HS5*a* is formed as illustrated in FIG. 12A. Next, it is folded in directions of two arrows in FIG. 12A. Then, as illustrated in FIG. 12B, the second part 21*b* of the upper end part 21 of the barrel portion 20 is bent along the second side 16*b* of the flange portion 16 such that a portion of the second part 21*b* overlaps the first part 21*a*. The second part 21*b* is bent utilizing the third ruled lines 48*c* and 49*c* such that the shape in plan view becomes a trapezoidal shape. The heat-seal portion HS5*b* is formed by heat-sealing the second part 21*b* to the upper surface 16*e* of the flange portion 16. In addition, the fourth part 21*d* of the upper end part 21 of the barrel portion 20 is bent along the fourth side 16*d* of the flange portion 16 such that a portion of the fourth part 21*d* overlaps the first part 21*a*. The fourth part 21*d* is bent utilizing the third ruled lines 48*c* and 49*c* such that the shape in plan view becomes a trapezoidal shape, and the heat-seal portion HS5*d* is formed by heat-sealing the fourth part 21*d* to the upper surface 16*e* of the flange portion 16. Next, it is folded in a direction of the arrow in FIG. 12B. Then, the third part 21*c* of the upper end part 21 of the barrel portion 20 is bent along the third side 16*c* of the flange portion 16 such that a portion of the third part 21*c* overlaps the second part 21*b* and the fourth part 21*d* utilizing the first ruled line 49*a*. The heat-seal portion HS5*c* is formed by heat-sealing the third part 21*c* to the upper surface 16*e* of the flange portion 16 such that the shape in plan view becomes a trapezoidal shape utilizing the second ruled lines 49*b* and 49*b*.

The spout-equipped packaging bag manufactured through steps (b2) to (b4) described above is preferable in terms of favorable appearance due to line-symmetric overlapping of the first part 21*a* to the fourth part 21*d* with respect to axes extending in the width direction and the depth direction about the spout 12, and from the viewpoint that concentration of warpage or the occurrence of wrinkles in parts of the upper end part of the barrel portion bent lastly is easily inhibited, and the upper end part of the tubular barrel portion is easily liquid-tightly adhered to the upper surface of the flange portion of the spout in a folded state.

In addition, in comparison between the method (α) and the method (β), the method (β) is more preferable than the method (α), from the viewpoint that concentration of warpage or the occurrence of wrinkles in parts of the upper end part of the barrel portion bent lastly is easily inhibited, and the upper end part of the tubular barrel portion is easily liquid-tightly adhered to the upper surface of the flange portion of the spout in a folded state.

In the manufacturing method for the spout-equipped packaging bag 1, the upper end part 21 of the tubular barrel portion 20 starts to be folded from the first part 21*a*. However, the position in the upper end part 21 where folding starts is not particularly limited.

The way of folding the upper end part of the tubular barrel portion is not limited to folding on the ruled lines 48 and 49 illustrated in FIGS. 8 and 9, and the upper end part need only be liquid-tightly adhered thereto.

Figure 16:
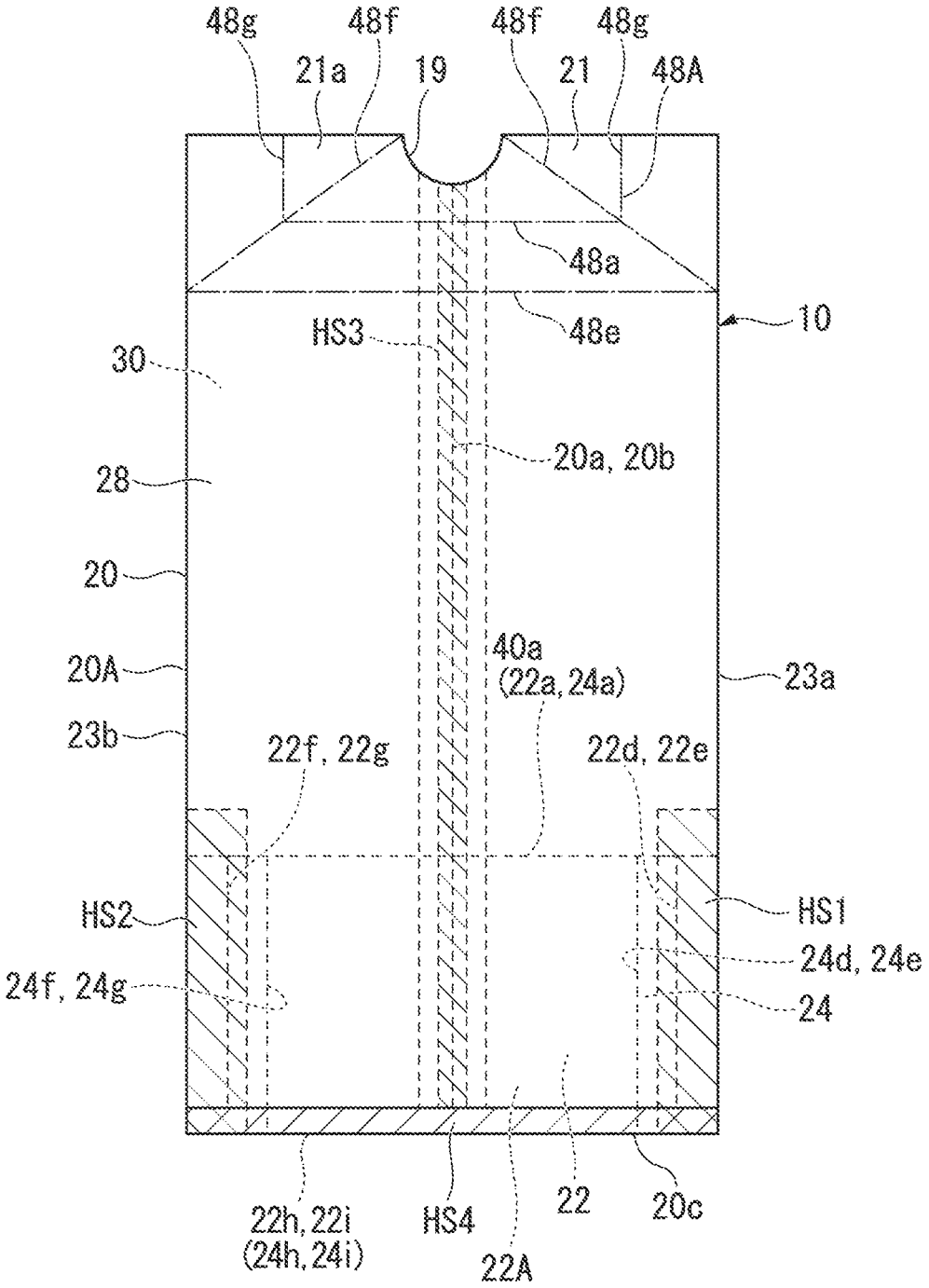
FIG. 16 is a view illustrating another manufacturing step for the spout-equipped packaging bag of the present invention and is a front view of the bag body before the spout is attached.
Figure 17:
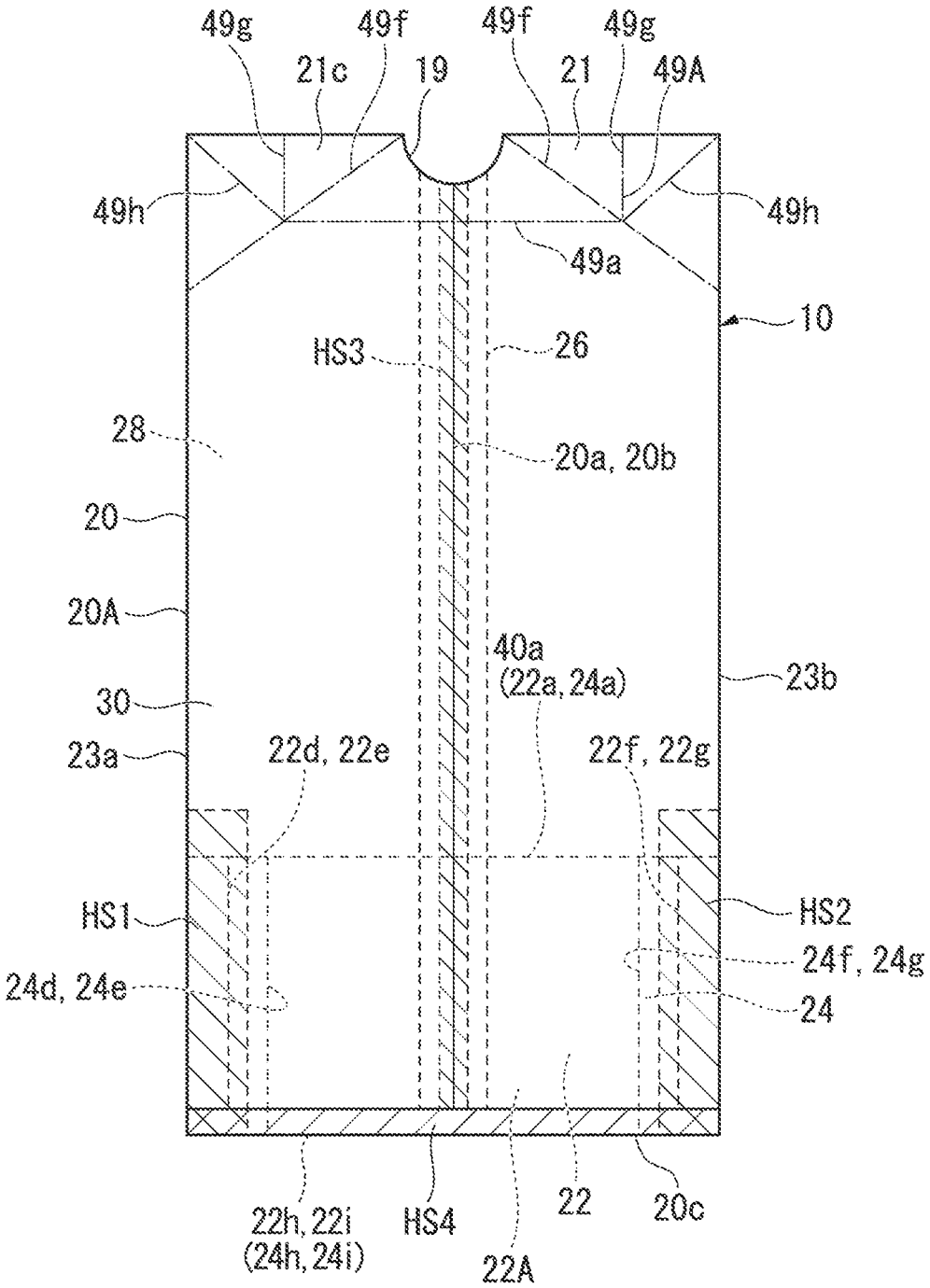
FIG. 17 is a view illustrating another manufacturing step for the spout-equipped packaging bag of the present invention and is a rear view of the bag body before the spout is attached.

In addition, even when ruled lines are formed, the shapes of the ruled lines 48 and 49 are not limited. In the spout-equipped packaging bag of the present invention, for example, the upper end part 21 of the barrel portion 20 may be folded utilizing ruled lines 48A and 49A illustrated in FIGS. 16 and 17 as an example, and the upper end part 21 of the barrel portion 20 may follow the shape of the flange portion 16 in plan view to be in the same shape.

The ruled line 48A is the same as the ruled line 48 except for having sixth ruled lines 48*f* and seventh ruled lines 48*g* in place of the second ruled lines 48*b*, the third ruled lines 48*c*, and the fourth ruled lines 48*d* described above.

The sixth ruled lines 48*f* and 48*f* extend linearly from the edges of the cut-out portion 19 on both sides to the side edges 23*a* and 23*b* of the front surface portion 28 through both ends of the first ruled line 48*a* and correspond to the legs of the trapezoid in the trapezoidal heat-seal portion HS5*a* to which the first pan 21*a* is heat-sealed. The seventh ruled lines 48*g* and 48*g* extend from both ends of the first ruled line 48*a* to the upper edge of the front surface portion 28 while being parallel to the side edges 23*a* and 23*b*. In this case, the bend lines of the seventh ruled lines 48*g* and 48*g* overlap the bend line 51*a*.

The ruled line 49A is the same as the ruled line 49 except for having sixth ruled lines 49*f* and seventh ruled line 49*g* in place of the second ruled line 49*b*, the third ruled line 49*c*, and the fourth ruled line 49*d* described above.

The sixth ruled lines 49*f* and 49*f* extends linearly from the edges of the cut-out portion 19 on both sides to the side edges 23*a* and 23*b* of the rear surface portion 30 through both ends of the first ruled line 49*a* and correspond to legs of the trapezoid in the trapezoidal heat-seal portion HS5*c* to which the third part 21*c* is heat-sealed. The seventh ruled lines 49*g* and 49*g* extend from both ends of the first ruled line 49*a* to the upper edge of the rear surface portion 30 while being parallel to the side edges 23*a* and 23*b*. In this case, the bend lines of the seventh ruled lines 49*g* and 49*g* overlap the bend line 53*a*.

When the front surface portion 28 has the seventh ruled lines 48*g* and 48*g* and the rear surface portion 30 has the seventh ruled lines 49*g* and 49*g*, the shapes of the heat-seal portion HS5*b* to which the second part 21*b* is heat-sealed and the heat-seal portion HS5*d* to which the fourth part 21*d* is heat-sealed become rectangular shapes instead of trapezoidal shapes.

Even in a case where the shape of the flange portion of the spout in plan view is a circular shape, similar to the case where the shape of the flange portion in plan view is substantially a polygonal shape, the entire upper end part of the barrel portion can be liquid-tightly adhered to the upper surface of the flange portion by repeating an operation in which the upper end part of the barrel portion is partially bent and is adhered to the upper surface of the flange portion. In this case, the number of times of folding the upper end part of the tubular barrel portion is not particularly limited and may be suitably set in accordance with the size and the like of the flange portion.

INDUSTRIAL APPLICABILITY

According to the present invention, it is possible to provide a spout-equipped packaging bag in which sufficient self-standing properties can be ensured even when the amount of contents decreases and discomfort when in use is reduced, a manufacturing method therefor, and a spout-equipped packaging bag that contains contents.

REFERENCE SIGNS LIST

1 Spout-equipped packaging bag
10 Bag body
12 Spout
14 Nozzle portion
16 Flange portion
16*a* First side
16*b* Second side
16*c* Third side
16*d* Fourth side
16*e* Upper surface
18 Cap portion
20 Barrel portion
20A Barrel member
21 upper end part
21*a* First part
21*b* Second part
21*c* Third part
21*d* Fourth part
22 Bottom portion
22A Bottom member
22*a* Bend line
24, 26 Adhesive film
28 Front surface portion
30 Rear surface portion
40 Laminated body
48, 49 Ruled line

The invention claimed is:

1. A self-standing spout-equipped packaging bag, comprising:

a bag body that stores contents; and a spout that is attached to an upper portion of the bag body, wherein the bag body includes a tubular barrel portion, and a bottom portion which is attached to block an opening end of a lower part of the barrel portion, wherein the spout includes a tubular nozzle portion, and a flange portion which projects from an outer surface of the nozzle portion, wherein a shape of the flange portion in plane view has a polygonal shape formed of a plurality of sides or a shape in which at least one of a plurality of corners in a polygonal shape formed of a plurality of sides has an arc shape, wherein the flange portion is inserted into an upper portion of the tubular barrel portion, wherein an upper end part of the tubular barrel portion includes a plurality of parts corresponding to the plurality of sides of the flange portion, each of the plurality of parts of the upper end part is individually bent along each of the plurality of sides of the flange portion and is liquid-tightly adhered to an upper surface of the flange portion such that the upper end part of the tubular barrel portion follows the shape of the flange portion in plane view to be in the same shape, wherein the barrel portion has a tubular shape with no side seal portion which projects outward in plane view, wherein two side ends of a barrel member forming the barrel portion are caused to abut each other and an adhesive film overlaps inner surfaces of the two side ends, or an inner surface of one of two side ends of a barrel member forming the barrel portion and an outer surface of the other of the two side ends are adhered to each other, wherein the barrel portion is configured to be changed into a flat shape including a front surface portion and a rear surface portion, wherein one of the front and rear surface portions is provided with two first fold lines, the two first fold lines extend from two ends of one side of the flange portion to two side edges of the flat shape of the barrel portion, the one side of the flange portion extends in a width direction of the barrel portion, and each first fold line diagonally extends from one end of the one side of the flange portion to an outside in the width direction and the bottom portion of the bag body, wherein the one of the front and rear surface portions is provided with a second fold line connecting intersection points between the two first fold lines and the two side edges, and wherein a distance between each intersection point and the one side of the flange portion in an up-down direction of the barrel portion is half a distance between the one side and another side of the flange portion, and the one side and the other side are opposite to each other and extend in the width direction of the barrel portion.

2. The spout-equipped packaging bag according to claim 1, wherein the upper end part of the barrel portion is folded on the upper surface of the flange portion and is adhered to the upper surface in a state of following the shape of the flange portion in plane view to be in the same shape.

3. The spout-equipped packaging bag according to claim 1, wherein the bottom portion folded in half is positioned inside of the barrel portion while having a fold line thereof on an upper side, each of side ends of the bottom portion is adhered to an inner surface of the barrel portion by means of an adhesive film, and the barrel portion and the bottom portion are adhered to each other throughout the entire circumference of the barrel portion of a lower part of the barrel portion.

4. A spout-equipped packaging bag that contains contents, wherein the contents are stored inside of the bag body of the spout-equipped packaging bag according to claim 1.

5. A manufacturing method for a self-standing spout-equipped packaging bag including a bag body that stores contents, and a spout that is attached to an upper portion of the bag body, the bag body including a tubular barrel portion, and a bottom portion which is attached to block an opening end of a lower part of the barrel portion, the spout including a tubular nozzle portion, and a flange portion which protrudes from an outer surface of the nozzle portion, a shape of the flange portion in plane view having a polygonal shape formed of a plurality of sides or a shape in which at least one of a plurality of corners in a polygonal shape formed of a plurality of sides has an arc shape, the barrel portion having a tubular shape with no side seal portion which projects outward in plane view, the barrel portion being configured to be changed into a flat shape including a front surface portion and a rear surface portion, one of the front and rear surface portions being provided with two first fold lines, the two first fold lines extending from two ends of one side of the flange portion to two side edges of the flat shape of the barrel portion, the one side of the flange portion extending in a width direction of the barrel portion, and each first fold line diagonally extending from one end of the one side of the flange portion to an outside in the width direction and the bottom portion of the bag body, the one of the front and rear surface portions being provided with a second fold line connecting intersection points between the two first fold lines and the two side edges, and a distance between each intersection point and the one side of the flange portion in an up-down direction of the barrel portion being half a distance between the one side and another side of the flange portion, and the one side and the other side being opposite to each other and extending in the width direction of the barrel portion, the manufacturing method comprising:

inserting the flange portion into an upper portion of the tubular barrel portion;

individually bending each of a plurality of parts included in an upper end part of the tubular barrel portion, the plurality of parts of the upper end part corresponding to the plurality of sides of the flange portion, along each of the plurality of sides of the flange portion, and liquid-tightly adhering each of the plurality of parts of the upper end part on an upper surface of the flange portion such that the upper end part of the tubular barrel portion follows the shape of the flange portion in plane view to be in the same shape, in a state where the barrel portion is folded along the first and second fold lines and is changed into the flat shape, and causing two side ends of a barrel member forming the barrel portion to abut each other and causing an adhesive film to overlap inner surfaces of the two side ends, or adhering an inner surface of one of two side ends of a barrel member forming the barrel portion to an outer surface of the other of the two side ends.

6. The manufacturing method for a spout-equipped packaging bag according to claim 5, wherein the shape of the flange portion in plane view is substantially a polygonal shape, and wherein the entire upper end part of the barrel portion is liquid-tightly adhered to the upper surface of the flange portion by repeating an operation in which a portion of the upper end part of the barrel portion is bent along one side of the flange portion and is adhered to the upper surface of the flange portion.

7. The manufacturing method for a spout-equipped packaging bag according to claim 6, wherein after respective parts of the upper end part of the barrel portion are bent along every other side of a plurality of sides of the flange portion and are adhered to the upper surface of the flange portion, remaining parts of the upper end part of the barrel portion are bent along remaining sides of the flange portion and are adhered to the upper surface of the flange portion.

8. The manufacturing method for a spout-equipped packaging bag according to claim 6, wherein after a portion of the upper end part of the barrel portion is bent along one side of the plurality of sides of the flange portion and is adhered to the upper surface of the flange portion, respective parts of the upper end part of the barrel portion are bent along respective sides of the flange portion and are adhered to the upper surface of the flange portion in a sequential order of moving round in one direction in plane view.

9. The manufacturing method for a spout-equipped packaging bag according to claim 6, wherein after a portion of the upper end part of the barrel portion is bent along one side of the plurality of sides of the flange portion and is adhered to the upper surface of the flange portion, respective parts of the upper end part of the barrel portion are bent along respective sides of the flange portion and are adhered to the upper surface of the flange portion in order of moving halfway round respectively in both directions in plane view.

10. The spout-equipped packaging bag according to claim 1, wherein a part of the tubular barrel portion connecting to the upper end part thereof is hung down from the outer edge of the flange portion.

11. The spout-equipped packaging bag according to claim 1, wherein in two parts next to each other of the plurality of parts of the upper end part, part of either one of the two parts overlaps the other of the two parts on the upper surface of the flange portion.

* * * * *